US008180247B2

(12) United States Patent
Nakagawa et al.

(10) Patent No.: US 8,180,247 B2
(45) Date of Patent: May 15, 2012

(54) IMAGE FORMING APPARATUS FOR TRANSFERRING TRANSFER RESIDUAL TONER ONTO IMAGE BEARING MEMBER

(75) Inventors: Ken Nakagawa, Mishima (JP); Kenji Kanari, Numazu (JP); Masaru Shimura, Numazu (JP); Takashi Shimada, Suntou-gun (JP); Tomoo Akizuki, Suntou-gun (JP); Masahiro Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/160,541

(22) Filed: Jun. 15, 2011

(65) Prior Publication Data

US 2011/0243617 A1 Oct. 6, 2011

Related U.S. Application Data

(63) Continuation of application No. 12/024,274, filed on Feb. 1, 2008, now Pat. No. 7,978,998.

(30) Foreign Application Priority Data

Feb. 6, 2007 (JP) ..... 2007-027411

(51) Int. Cl.
*G03G 15/16* (2006.01)

(52) U.S. Cl. ..... 399/101; 399/129

(58) Field of Classification Search ..... 399/101, 399/129, 298, 299, 302
See application file for complete search history.

(56) References Cited

U.S. PATENT DOCUMENTS 5,732,310 A 3/1998 Hiroshima et al.
6,385,428 B1 5/2002 Uchida et al.
6,453,139 B2 9/2002 Sasame et al.
6,473,574 B1 10/2002 Usui et al.
6,934,497 B2 8/2005 Hagiwara et al.
6,963,716 B2 11/2005 Kobayashi et al.
(Continued)

FOREIGN PATENT DOCUMENTS

CN 1139221 A 1/1997
(Continued)

OTHER PUBLICATIONS

Office Action dated May 15, 2009, issued in counterpart Chinese Application No. 200810004841.4.
(Continued)

*Primary Examiner* — William J Royer
(74) *Attorney, Agent, or Firm* — Fitzpatrick, Cella, Harper & Scinto

(57) ABSTRACT

There is a charge member which charges secondary transfer remaining toner on an intermediate transfer member to a polarity opposite to a normal charge polarity. The transfer remaining toner charged by the charge member is moved in the direction opposite to that of normal toner by a transfer bias and moved from the intermediate transfer member onto an image bearing member. A BK station is arranged on the downstream of other stations. In a continuous BK monochromatic mode, by applying a reverse bias to transfer portions of the other stations and applying the transfer bias only to the BK station, waste toner can be collected into the BK station (simultaneously with the transfer). In a full-color mode, since each transfer bias is applied to all stations, the waste toner is collected into the station on the uppermost stream. Thus, the image bearing member for collecting the transfer remaining toner on the intermediate transfer member is made different according to the mode, thereby suppressing that the collection of the waste toner is concentrated on one image bearing member.

10 Claims, 7 Drawing Sheets

U.S. PATENT DOCUMENTS

| | | | | |
|---|---|---|---|---|
| 6,965,743 | B2 | 11/2005 | Nakagawa et al. | |
| 7,477,863 | B2 | 1/2009 | Watanabe et al. | |
| 7,978,998 | B2 * | 7/2011 | Nakagawa et al. | 399/101 |
| 2007/0025778 | A1 | 2/2007 | Akizuki et al. | |

FOREIGN PATENT DOCUMENTS

| | | | |
|---|---|---|---|
| CN | 1459676 | A | 12/2003 |
| JP | 9-50167 | A | 2/1997 |
| JP | 2000-352852 | A | 12/2000 |
| JP | 2001-66910 | A | 3/2001 |
| JP | 2001-147632 | A | 5/2001 |
| JP | 2001-175047 | A | 6/2001 |
| JP | 2001-201912 | A | 7/2001 |
| JP | 2004-21134 | A | 1/2004 |
| JP | 2004-21142 | A | 1/2004 |
| JP | 2006-139063 | A | 6/2006 |
| JP | 2007-11414 | A | 1/2007 |

OTHER PUBLICATIONS

Notice of Reasons for Refusal, dated Feb. 1, 2012, in Japanese Application No. 2007-027411.

* cited by examiner

IMAGE FORMING APPARATUS FOR TRANSFERRING TRANSFER RESIDUAL TONER ONTO IMAGE BEARING MEMBER

This application is a continuation of U.S. patent application Ser. No. 12/024,274, filed Feb. 1, 2008.

BACKGROUND OF THE INVENTION

1. Field of the Invention

The present invention relates to an image forming apparatus for charging transfer residual toner on an intermediate transfer member and transferring the charged transfer residual toner onto an image bearing member, thereby removing the toner from the intermediate transfer member.

2. Description of the Related Art

Hitherto, an image forming apparatus of an intermediate transfer system using an intermediate transfer member has been known as an image forming apparatus of an electrophotographic system such as a copying apparatus, laser beam printer, or the like. The image forming apparatus of the intermediate transfer system forms a color image (multicolor image) or the like onto a recording material by a primary transfer process and a secondary transfer process.

That is, first, as a primary transfer process, a toner image as a transferable image formed on the surface of an electrophotographic photosensitive member (hereinbelow, simply referred to as a "photosensitive member") serving as an image bearing member is transferred (primary transfer) onto the intermediate transfer member also serving as an image bearing member.

By overlappingly executing the primary transfer process with respect to toner images of a plurality of colors, a multiple toner image constructed by the toner images of the plurality of colors is formed on the surface of the intermediate transfer member. Subsequently, as a secondary transfer process, the toner image on which the toner materials of the plurality of colors have been overlaid and which has been formed on the surface of the intermediate transfer member is transferred (secondary transfer) in a lump onto the surface of a recording material such as paper or the like.

In the image forming apparatus of the intermediate transfer system, after the secondary transfer of the toner image from the intermediate transfer member onto the recording material was executed, the toner remains as secondary transfer remaining toner (transfer remaining toner, residual toner) on the surface of the intermediate transfer member. Therefore, in order to remove the transfer remaining toner which remains on the surface of the intermediate transfer member, the following image forming apparatus has been proposed as disclosed in Japanese Patent Application Laid-Open No. 9-50167. The image forming apparatus disclosed in Japanese Patent Application Laid-Open No. 9-50167 has a charging unit arranged on a downstream side of a secondary transfer position in a moving direction of a surface of an intermediate transfer member and a charging unit arranged on an upstream side of a primary transfer nip. The charging units charge secondary transfer remaining toner to a polarity opposite to that of a surface electric potential of a first image bearing member. That is, the secondary transfer remaining toner is charged to the polarity opposite to a normal charge polarity of the toner. The secondary transfer remaining toner of the opposite polarity on the intermediate transfer member is transferred and returned to the surface of a photosensitive member through the primary transfer nip simultaneously with the primary transfer (system in which the toner is collected simultaneously with the transfer). The transfer remaining toner returned to the photosensitive member is collected by a cleaning member which faces the photosensitive member.

In Japanese Patent Application Laid-Open No. 2004-21134, an image forming apparatus of a tandem system having a charger (contact type charge member) for charging secondary transfer remaining toner to a polarity opposite to a normal charge polarity has been proposed. The image forming apparatus of the tandem system has a plurality of image forming units (hereinbelow, referred to as "a station" or "stations") each of which has an image bearing member and a waste toner container for enclosing toner removed from the surface on the image bearing member and forms an image by different kind (color) of toner. According to the image forming apparatus of the tandem system, a large quantity of secondary transfer remaining toner is enclosed into the specific waste toner container and an exchange frequency of only its cartridge increases, so that it is uneconomical. Therefore, in the image forming apparatus disclosed in Japanese Patent Application Laid-Open No. 2004-21134, by increasing a capacity of the waste toner container of only the cartridge in which a large quantity of secondary transfer remaining toner is enclosed, the exchange frequency of the cartridge in which the large quantity of secondary transfer remaining toner is enclosed is decreased. However, there is such an inconvenience that the cartridge enlarges by increasing the capacity of the waste toner container. In addition, if the waste toner is repetitively collected into the cartridge which is not used for image forming, the waste toner container having the large capacity will be filled with the waste toner soon.

As another related art, in U.S. Pat. No. 6,473,574, in an image forming apparatus of a tandem system, a method whereby one of a toner caused at a time of a test image forming or a jam occurrence and a toner remaining as fogging toner on a moving member is distributed to different stations and collected has been proposed. However, according to the invention disclosed in U.S. Pat. No. 6,473,574, timing for a primary transfer and timing for cleaning transfer remaining toner on an intermediate transfer member differ and it takes time for the cleaning.

SUMMARY OF THE INVENTION

It is an object of the invention that image bearing members for collecting transfer remaining toner on an intermediate transfer member are made different according to a mode, thereby suppressing a collection of waste toner from being concentrated on one image bearing member.

Another object of the invention is to provide an image forming apparatus comprising: a first image bearing member which bears a toner image; a second image bearing member which bears a toner image; an intermediate transfer member which transfers the toner image onto a recording material from the intermediate transfer member; a first transfer member which transfers a toner image charged in a normal polarity from the first image bearing member onto the intermediate transfer member; a second transfer member which transfers the toner image charged in the normal polarity from the second image bearing member onto the intermediate transfer member; and a charge member which charges the residual toner remaining on the intermediate transfer member after the transfer of a toner image from the intermediate transfer member onto the recording material to a polarity opposite to the normal polarity, wherein when the toner images are continuously formed onto a plurality of recording materials only by a toner image on the second image bearing member, a voltage of a polarity opposite to a polarity of a voltage which is applied to the second transfer member is applied to the first transfer member, and the residual toner is transferred from the intermediate transfer member onto the second image bearing member simultaneously with the transfer of a toner image from the second image bearing member onto the intermediate transfer member.

Another object of the invention is to provide an image forming apparatus comprising: a first image bearing member which bears a toner image; a second image bearing member which bears a toner image; an endless intermediate transfer member which transfers the toner image onto a recording material from the endless intermediate transfer member; a first transfer member which transfers a toner image charged in a normal polarity from the first image bearing member onto the intermediate transfer member; a second transfer member which transfers the toner image charged in a normal polarity from the second image bearing member onto the intermediate transfer member; a charge member which charges the residual toner remaining on the intermediate transfer member after the transfer of a toner image from the intermediate transfer member onto the recording material to a polarity opposite to the normal polarity; a first mode in which the toner image on the second image bearing member is transferred onto the intermediate transfer member so as to be overlaid onto the toner image transferred from the first image bearing member onto the intermediate transfer member; and a second mode in which only the toner image on the second image bearing member is transferred onto the recording material through the intermediate transfer member, wherein when the transfer is continuously executed onto a plurality of recording materials in the second mode, a voltage of a polarity opposite to a polarity of a voltage which is applied to the second transfer member is applied to the first transfer member, and the residual toner is transferred from the intermediate transfer member onto the second image bearing member simultaneously with the transfer of the toner image from the second image bearing member onto the intermediate transfer member.

Further another object of the invention is to provide an image forming apparatus comprising: a first image bearing member which bears a toner image; a second image bearing member which bears a toner image; an endless intermediate transfer member which transfers the toner image onto a recording material from the endless intermediate transfer member; a first transfer member which receives an application of a first transfer voltage and transfers a toner image charged in a normal polarity from the first image bearing member onto the intermediate transfer member; a second transfer member which receives an application of a second transfer voltage and transfers the toner image charged in the normal polarity from the second image bearing member onto the intermediate transfer member; and a charge member which charges the residual toner remaining on the intermediate transfer member after the transfer of the toner image from the intermediate transfer member onto the recording material to a polarity opposite to the normal polarity, wherein in a mode which continuously forms the toner images onto a plurality of recording materials only by a toner image on the second image bearing member, a voltage of a polarity opposite to a polarity of the first transfer voltage is applied to the first transfer member, and the second transfer voltage is applied to the second transfer member while a toner image on the second image bearing member and the residual toner charged by the charge member enter between the second image bearing member and the second transfer member.

Still another object of the invention is to provide an image forming apparatus comprising: a first image bearing member which bears a toner image; a second image bearing member which bears a toner image; an intermediate transfer member which transfers the toner image onto a recording material; and a charge member which charges the residual toner remaining on the intermediate transfer member after the transfer of the toner image from the intermediate transfer member onto the recording material to a polarity opposite to a normal polarity, wherein when the toner images are continuously formed onto a plurality of recording materials only by the toner image on the second image bearing member, the first image bearing member is separated from the intermediate transfer member, the second image bearing member comes into contact with the intermediate transfer member, and the residual toner is transferred from the intermediate transfer member onto the second image bearing member simultaneously with the transfer of the toner image from the second image bearing member onto the intermediate transfer member.

Still another object of the invention is to provide an image forming apparatus comprising: a first image bearing member which bears a toner image; a second image bearing member which bears a toner image; an endless intermediate transfer member which transfers the toner image onto a recording material; a charge member which charges the residual toner remaining on the intermediate transfer member after the transfer of the toner image from the intermediate transfer member onto the recording material to a polarity opposite to a normal polarity; a first mode in which the first image bearing member and the second image bearing member are come into contact with the intermediate transfer member and the toner image on the second image bearing member is transferred onto the intermediate transfer member so as to be overlaid onto the toner image transferred from the first image bearing member onto the intermediate transfer member; and a second mode in which the first image bearing member is separated from the intermediate transfer member, the second image bearing member comes into contact with the intermediate transfer member, and only the toner image on the second image bearing member is transferred onto the recording material through the intermediate transfer member, wherein when the transfer is continuously executed onto a plurality of recording materials in the second mode, the residual toner charged by the charge member is transferred from the intermediate transfer member onto the second image bearing member simultaneously with the transfer of the toner image from the second image bearing member onto the intermediate transfer member.

Further features of the present invention will become apparent from the following description of exemplary embodiments (with reference to the attached drawings).

DESCRIPTION OF THE EMBODIMENTS

Exemplary embodiments of the invention will be explicitly described in detail hereinbelow with reference to the drawings. However, dimensions, materials, and shapes of component parts, their relative layer, and the like disclosed in the following embodiments should be properly modified according to a construction and various conditions of an apparatus to which the invention is applied. Therefore, a scope of the invention is not limited only to them unless otherwise specified.

An image forming apparatus according to the invention will be described further in detail hereinbelow with reference to the drawings.

Embodiment 1

Whole Construction and Operation of Image Forming Apparatus (1) Whole Construction of Image Forming Apparatus First, a whole construction and the operation of an embodiment of the image forming apparatus according to the invention will be described.

Figure 1:
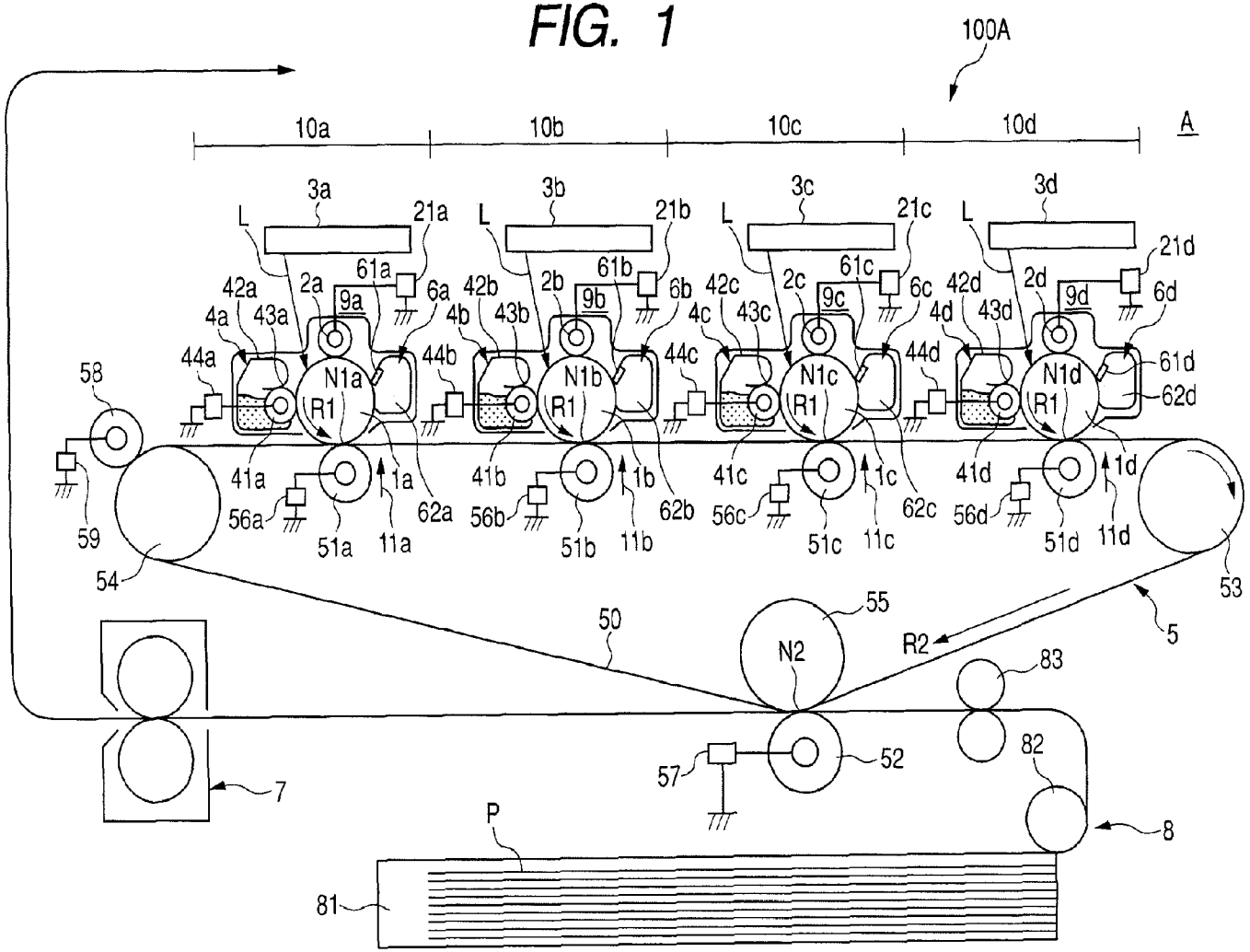
FIG. 1 is a schematic cross sectional constructional diagram of an image forming apparatus according to the first embodiment of the invention.

FIG. 1 illustrates a schematic cross sectional construction of an image forming apparatus 100A according to the embodiment. The image forming apparatus 100A according to the embodiment is a laser beam printer using one of the tandem system and the intermediate transfer system. As will be described in detail hereinafter, according to the image forming apparatus 100A of the embodiment, secondary transfer remaining toner is collected by a system in which the toner is collected simultaneously with a transfer.

The image forming apparatus 100A has first, second, third, and fourth stations (image forming stations) 10*a*, 10*b*, 10*c*, and 10*d* serving as a plurality of image forming units. The first, second, third, and fourth stations 10*a*, 10*b*, 10*c*, and 10*d* are arranged in a line in this order from an uppermost-stream side along the moving direction of the surface of an intermediate transfer belt 50 serving as an intermediate transfer member.

In the embodiment, the first, second, third, and fourth stations 10*a*, 10*b*, 10*c*, and 10*d* are stations for forming toner images of the colors of yellow (Y), magenta (M), cyan (C), and black (K), respectively.

In the embodiment, the fundamental constructions and operations of the first to fourth stations 10*a* to 10*d* are substantially identical except that the colors of the toner which are used are different. Therefore, suffixes a, b, c, and d allocated to reference numerals in order to show the component elements provided for the respective colors are omitted and a description is generally made hereinbelow in the case where it is unnecessary to distinguish them in particular.

A cylindrical electrophotographic photosensitive material serving as an image bearing member, that is, a photosensitive drum 1 is provided for the station 10. The photosensitive drum 1 is rotated in the direction shown by an arrow R1 in the diagram (counterclockwise). In the embodiment, the photosensitive drum 1 is an organic photo-conductive (OPC) member photosensitive drum. That is, in the embodiment, the photosensitive drum 1 is formed in such a manner that a plurality of layers of functional organic materials including a carrier generating layer which is photo-sensed and generates charges, a charge transporting layer which transports the generated charges, and the like are laminated onto a metal cylinder, and an outermost layer has a low electric conductivity and is almost insulative.

A charge roller (photosensitive charge member) 2 serving as a charging device (charging unit) for charging the photosensitive drum 1 is provided around the photosensitive drum 1. The charge roller 2 comes into contact with the photosensitive drum 1 and uniformly charges the surface of the photosensitive drum 1 while being rotated in association with a rotation of the photosensitive drum 1. In the embodiment, a charge polarity of the photosensitive drum 1 is a negative polarity. One of a DC voltage and a voltage obtained by superimposing an AC voltage to the DC voltage is applied to the charge roller 2. Since a discharge occurs in micro air gaps on the upstream side and the downstream side of an abut-on nip portion between the charge roller 2 and the surface of the photosensitive drum 1 in the rotating direction of the photosensitive drum 1, the photosensitive drum 1 is charged.

An exposure device 3 serving as an exposing unit is arranged so that the charged surface of the photosensitive drum 1 can be exposed. As an exposure device 3, one of a scanner unit for scanning a laser beam by a polygon mirror and an LED array can be used. In the embodiment, the exposure device 3 is constructed by the scanner unit and irradiates a scanning beam L modulated based on an image signal onto the photosensitive drum 1. Thus, an electrostatic image (latent image) based on an image signal is formed on the photosensitive drum 1.

A developing device (developing unit) 4 serving as a developing unit for developing the electrostatic image formed on the photosensitive drum 1 is provided around the photosensitive drum 1. The developing device 4 has a developer tank 42 for storing a non-magnetic 1-component developer as a developing agent, that is, toner. The developer tank 42 has a developing roller 41 serving as a developer bearing member and a developer coating blade 43 serving as a developer restricting member.

A cleaning device (cleaning unit) 6 for cleaning the toner on the photosensitive drum 1 is provided around the photosensitive drum 1. The cleaning device 6 has a waste toner container 62 as a container for storing the toner removed from the surface of the photosensitive drum 1. The waste toner container 62 has a cleaning blade 61 serving as a cleaning member as a cleaning unit for removing the toner from the photosensitive drum 1. The cleaning blade 61 comes into contact with the photosensitive drum 1, scrapes off the toner on the photosensitive drum 1, and collects the toner into the waste toner container 62.

Further, an intermediate transfer unit (intermediate transfer device) 5 having the intermediate transfer belt 50 formed by an endless belt serving as an intermediate transfer member is provided so as to face the photosensitive drum 1 of each station 10. A primary transfer roller 51 as a primary transfer member (rotation member) serving as a primary transfer unit is arranged in the intermediate transfer unit 5 at a position where it faces the photosensitive drum 1 of each station 10 on the inner peripheral surface side of the intermediate transfer belt 50. The primary transfer roller 51 presses the intermediate transfer belt 50 toward the photosensitive drum 1 and forms a nip (primary transfer nip) in a primary transfer portion N1 where the intermediate transfer belt 50 comes into contact with the photosensitive drum 1. A secondary transfer roller 52 as a secondary transfer member (rotation member) serving as a secondary transfer unit is arranged at a position where it faces a secondary transfer opposing roller 55 as one of support members of the intermediate transfer belt 50 on the outer peripheral surface side of the intermediate transfer belt 50. The secondary transfer roller 52 is pressed to the intermediate transfer belt 50, thereby forming a nip (secondary transfer nip) in a secondary transfer portion N2 where the secondary transfer roller 52 comes into contact with the intermediate transfer belt 50. Further, in the embodiment, a toner charge roller 58 as a secondary transfer remaining toner charge member (rotation member) serving as a toner charging unit is arranged at a position where it faces a tension roller 54 as one of the support members of the intermediate transfer belt 50 on the outer peripheral surface side of the intermediate transfer belt 50. The toner charge roller 58 is arranged in contact with the intermediate transfer belt 50. That is, in the embodiment, the toner charge roller 58 which comes into contact with the surface of the intermediate transfer belt 50 is arranged on each of the downstream side of the secondary transfer portion N2 in the moving direction of the surface of the intermediate transfer belt 50 and the upstream side of a primary transfer portion N1*a* of the first station 10*a*.

The image forming apparatus 100A further has: a fixing device 7 serving as a fixing unit for fixing the toner transferred to a recording material P onto the recording material P; a recording material supply device 8 for feeding the recording material P on which an image is formed; and the like.

In the embodiment, the photosensitive drum 1 and the charge roller 2, developing device 4, and cleaning device 6 serving as processing units which act on the photosensitive drum 1 are constructed as an integrated process cartridge 9 which is detachable from a main body of the image forming apparatus 100A (hereinbelow, simply referred to as an apparatus main body) A. The process cartridge 9 denotes a cartridge in which the photosensitive drum 1 and at least one of the charging unit 2, developing unit 4, and cleaning unit 6 serving as processing units which act on the photosensitive drum 1 have been integrated and which is detachable from the main body A of the image forming apparatus 100A.

The charge roller 2 is connected to a charge bias power supply 21 serving as a voltage application device (bias output unit) for applying a voltage to the charge roller 2. The developing roller 41 is connected to a developing bias power supply 44 serving as a voltage application device (bias output unit) for applying a voltage to the developing roller 41. The primary transfer roller 51 is connected to a primary transfer bias power supply 56 serving as a voltage application device (bias output unit) for applying a voltage to the primary transfer roller 51. The secondary transfer roller 52 is connected to a secondary transfer bias power supply 57 serving as a voltage application device (bias output unit) for applying a voltage to the secondary transfer roller 52. Further, the toner charge roller 58 is connected to a toner charge bias power supply 59 serving as a voltage application device (bias output unit) for applying a voltage to the toner charge roller 58.

The intermediate transfer belt 50 is supported by three rollers of a driving roller 53, the tension roller 54, and the secondary transfer opposing roller 55 as support members and can maintain a proper tension. By rotating the driving roller 53, the intermediate transfer belt 50 is moved at an almost constant speed in the forward direction to the photosensitive drum 1.

In the embodiment, an endless belt made of PVDF having a thickness of 100 μm and a volume sensitivity of $10^{11}$ Ωcm is used as the intermediate transfer belt 50. As the driving roller 53 serving as a support member, a roller having a diameter of 30 mm obtained by coating a metal core made of aluminum with EPDM rubber having a resistance of $10^4$Ω and a thickness of 1.0 mm into which carbon has been dispersed as a conductive material is used. A metal rod having a diameter of 30 mm made of aluminum is used as the tension roller 54 serving as the support member. The tensions which are applied to the intermediate transfer belt 50 in both end portions in the rotational axial direction of the tension roller 54 are set to 19.6 N on one side and 39.2 N as a total pressure.

The intermediate transfer belt 50 rotates (circulation movement) in the direction shown by an arrow R2 in the diagram (clockwise). The primary transfer roller 51 is arranged on the opposite side of the photosensitive drum 1 so as to sandwich the intermediate transfer belt 50.

A neutralization member (neutralization needle) 11 is arranged on the downstream side of each primary transfer roller 51 in the rotating direction (moving direction) of the intermediate transfer belt 50 so as to be located on the inner peripheral surface side of the intermediate transfer belt 50.

The driving roller 53, tension roller 54, neutralization member 11, and secondary transfer opposing roller 55 are electrically connected to the ground.

In the embodiment, as the primary transfer roller 51, a roller obtained by coating a nickel-plated steel rod having a diameter of 6 mm with a sponge-foam elastic member of NBR having a thickness of 4 mm is used. A resistance value of the primary transfer roller 51 is equal to $4\times10^8$Ω at a volume absolute humidity of 1 g/m$^3$ when 500 V has been applied and is equal to $2.5\times10^7$Ω at a volume absolute humidity of 25 g/m$^3$ when 500 V has been applied.

In the embodiment, as the secondary transfer roller 52, a roller obtained by coating a nickel-plated steel rod having a diameter of 6 mm with a sponge-foam elastic member of NBR having a thickness of 5 mm is used. A resistance value of the secondary transfer roller 52 is equal to $4\times10^7$Ω at a volume absolute humidity of 1 g/m$^3$ when 500 V has been applied and is equal to $2.5\times10^6$Ω at a volume absolute humidity of 25 g/m$^3$ when 500 V has been applied.

In the embodiment, the secondary transfer roller 52 comes into contact with the intermediate transfer belt 50 at a linear pressure of about 5 to 15 g/cm and is arranged so as to be rotated at an almost constant speed in the forward direction to the moving direction of the surface of the intermediate transfer belt 50.

In the embodiment, as the toner charge roller 58, a roller obtained by coating a nickel-plated steel rod having a diameter of 6 mm with a solid elastic member having a thickness of 5 mm in which carbon has been dispersed into EPDM rubber is used. A resistance value of the toner charge roller 58 is equal to $4\times10^6$Ω at a volume absolute humidity of 1 g/m$^3$ when 100 V has been applied and is equal to $2.5\times10^6$Ω at a volume absolute humidity of 25 g/m$^3$ when 100 V has been applied.

Figure 2:
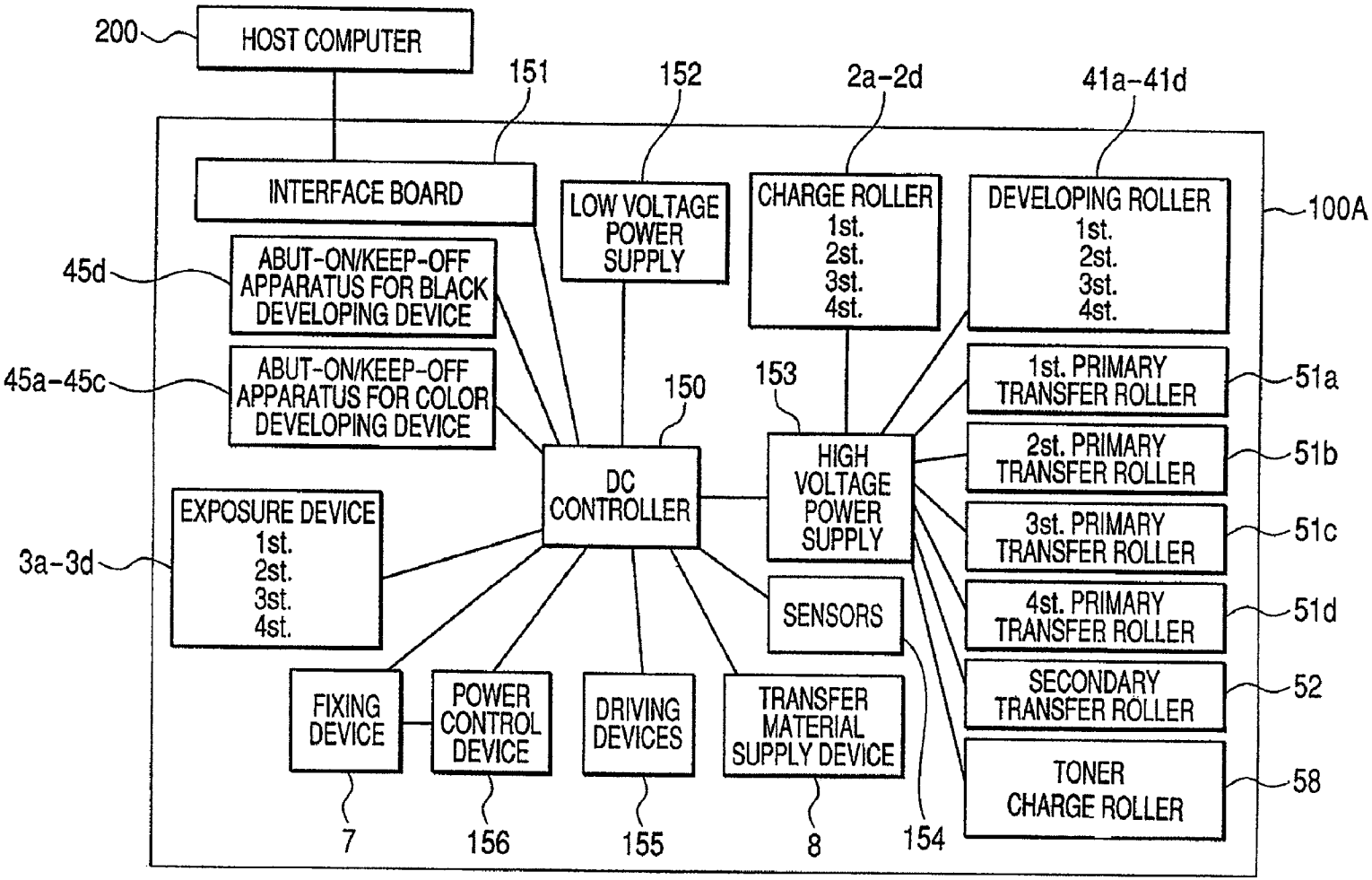
FIG. 2 is a block diagram for describing the operation of the image forming apparatus according to the first embodiment of the invention.

FIG. 2 is a block diagram for describing the operation of the image forming apparatus 100A according to the embodiment.

A host computer 200 plays a role for issuing a print command and transferring image data of a print image to an interface board (I/F board) 151 provided in the image forming apparatus 100A. The I/F board 151 converts the image data from the host computer 200 into exposure data and issues the print command to a DC controller 150 serving as a control unit. When an electric power is supplied from a low voltage power supply 152, the DC controller 150 operates. When the print command is received, the DC controller 150 starts an image forming sequence while monitoring states of various sensors 154.

The DC controller 150 has therein a CPU, a memory, and the like (not shown) and executes the operation which has previously been programmed. Specifically speaking, the DC controller 150 controls the operations of various driving devices 155 such as driving devices of the main motor, developing device 4, and photosensitive drum 1, and the like and, at the same time, controls the exposure device 3 so that an exposure light amount is stabilized. The DC controller 150 also controls a power control device 156 connected to the fixing device 7 and controls an electric power so that a temperature of the fixing device 7 is maintained to a predetermined temperature. The DC controller 150 also discriminates one of a full-color mode and a monochromatic mode and controls the operation of an abut-on/keep-off apparatus 45*d* for the black developing device for allowing the black developing device 4*d* to be come into contact with or be separated from the photosensitive drum 1*d*. Similarly, the DC controller 150 controls the operations of abut-on/keep-off apparatuses 45*a* to 45*c* for the color developing devices for allowing the color developing devices 4*a* to 4*c* to be come into contact with or be separated from the photosensitive drums 1*a* to 1*c*, respectively. Further, while monitoring application voltages and currents from a plurality of high voltage power supply units provided for a high voltage power supply 153, the DC controller 150 controls the high voltage power supply 153 at a control voltage, a control current, and timing which have preliminarily been programmed. As a plurality of high voltage power supply units provided for the high voltage power supply 153, the foregoing charge bias power supply 21, developing bias power supply 44, primary transfer bias power supply 56, secondary transfer bias power supply 57, and toner charge bias power supply 59 are included.

That is, various function parts to form the image are connected to the high voltage power supply 153. For example, the charge roller 2 provided for each station 10 receives the high voltage from the high voltage power supply 153 (charge bias power supply 21), comes into contact with or closely approaches the photosensitive drum 1 of each station 10, and plays a role for charging the surface of the photosensitive drum 1 to a uniform electric potential. Control of the charge electric potential is made by a method whereby the DC controller 150 controls the high voltage produced in the high voltage power supply 153 (charge bias power supply 21). Similarly, high voltages are also supplied from the high voltage power supply 153 to the developing roller 41, primary transfer roller 51, secondary transfer roller 52, and toner charge roller 58. Their application voltages and application currents are controlled by the DC controller 150, respectively.

(2) Image Forming Operation of Image Forming Apparatus

The image forming operation of the image forming apparatus 100A in the embodiment will now be described.

(2-1) Full-Color Mode

First, the image forming operation of the full-color mode (multicolor image forming mode) in which a full-color image can be formed by using all of the first to fourth stations 10*a* to 10*d* will be described.

When the print command of a full-color print is received in a standby mode, the image forming apparatus 100A starts the image forming operation in the full-color mode and starts a driving of each driving device, an activation of the exposure device 3, an activation of the fixing device 7, and a high voltage applying sequence. Each of the photosensitive drum 1, the intermediate transfer belt 50, and the like starts the rotation at a predetermined processing speed in the direction shown by an arrow in the diagram.

When the bias is supplied from the charge bias power supply 21 to the charge roller 2, the photosensitive drum 1 is uniformly charged to a predetermined electric potential (in the embodiment, 500 V) of a predetermined polarity (in the embodiment, negative polarity). Subsequently, an electrostatic image (latent image) according to the image information is formed on the charged surface of the photosensitive drum 1 by the scanning beam L from the exposure device 3.

The toner in the developing device 4 is charged to a predetermined polarity (in the embodiment, negative polarity) by the developer coating blade 43. The developing roller 41 is coated with the charged toner. A bias of a predetermined electric potential (in the embodiment, −300 V) of a predetermined polarity (in the embodiment, negative polarity) is supplied from the developing bias power supply 44 to the developing roller 41. Thus, when the photosensitive drum 1 rotates and the electrostatic image formed on the photosensitive drum 1 reaches a portion (developing portion) which faces the developing roller 41, the electrostatic image is visualized by the toner of the negative polarity and a toner image of the color corresponding to each station is formed on the photosensitive drum 1.

As mentioned above, in the embodiment, the developing device 4 develops the electrostatic image by an inversion developing system in which the toner charged to the same polarity as the charge polarity of the photosensitive drum 1 is deposited to a portion (exposing portion, image portion) whose charges have been attenuated by the exposure of the charged surface of the photosensitive drum 1.

In the full-color mode, first, the toner image of the first color (Y color in the embodiment) is formed on the photosensitive drum 1*a* of the first station 10*a*. The second to fourth stations 10*b*, 10*c*, and 10*d* also similarly operate and the toner images of the colors of M, C, and K are formed on the photosensitive drums 1*b*, 1*c*, and 1*d*, respectively. At this time, the electrostatic image is formed on each of the photosensitive drums 1*a* to 1*d* every color by the exposure device 3 while delaying a write signal from the DC controller 150 at predetermined timing according to a distance between the primary transfer positions.

Subsequently, DC biases of a polarity (that is, in the embodiment, positive polarity) opposite to a normal charge polarity of the toner are applied from the primary transfer bias power supplies 56*a* to 56*d* to the primary transfer rollers 51*a* to 51*d* of the stations 10*a* to 10*d*.

By the above processes, the toner images of the colors of Y, M, C, and K are sequentially overlappingly transferred (primary transfer) onto the intermediate transfer belt 50 and a multiple image is formed on the intermediate transfer belt 50.

The toner (primary transfer remaining toner) remaining on the photosensitive drum 1 after the primary transfer process is removed and collected by the cleaning device 6.

After that, the recording material P is supplied to the secondary transfer portion N2 by the recording material supply device 8 according to the image forming of the electrostatic image which is executed by the exposure. That is, the recording materials P enclosed in a recording material cassette are picked up one by one by a recording material supply roller 82 and conveyed to a registration roller 83 by a conveying roller (not shown). Subsequently, synchronously with the toner image on the intermediate transfer belt 50, the recording material P is conveyed by the registration roller 83 to the abut-on portion (secondary transfer portion) N2 which is formed by the intermediate transfer belt 50 and the secondary transfer roller 52.

A bias of a polarity (that is, in the embodiment, positive polarity) opposite to the normal charge polarity of the toner is applied to the secondary transfer roller 52 by the secondary transfer bias power supply 57. Thus, the multiple toner image of the four colors held on the intermediate transfer belt 50 is transferred (secondary transfer) onto the recording material P in a lump.

The toner remaining on the intermediate transfer belt 50 after the secondary transfer process, that is, the secondary transfer remaining toner is charged by the toner charge roller 58 arranged so as to abut on the intermediate transfer belt 50. The toner charge bias power supply 59 is connected to the toner charge roller 58. A voltage obtained by superimposing a DC voltage of +500 V to an AC voltage in which a frequency is equal to 1 kHz and a voltage between peaks is equal to 1800 V is applied to the toner charge roller 58.

The toner having the normal charge polarity (in the embodiment, negative polarity) before the secondary transfer process is ordinarily transferred onto the recording material P in the secondary transfer process. Therefore, in the secondary transfer remaining toner, there is a large quantity of toner which has been charged to the polarity (that is, in the embodiment, positive polarity) opposite to the normal charge polarity, in other words, there is a large quantity of toner whose polarity has been inverted. However, the polarities of all of the secondary transfer remaining toner are not inverted but the toner which has been neutralized and has no charges or the toner which maintains the negative polarity also exists partially.

Between the toner charge roller 58 and the intermediate transfer belt 50, a discharge has occurred in micro gap portions on the upstream side and the downstream side of the abut-on nip portion. There is an action for charging the secondary transfer remaining toner on the intermediate transfer belt 50 to the side of the polarity (that is, in the embodiment, positive polarity) opposite to the normal charge polarity. In the embodiment, typically, the toner charge roller 58 charges substantially all of the secondary transfer remaining toner on the intermediate transfer belt 50 to the polarity opposite to the normal charge polarity.

The secondary transfer remaining toner subjected to the charging process by the toner charge roller 58 is moved to the station 10 in a state where it is held on the intermediate transfer belt 50, reversely transferred onto the photosensitive drum 1, and collected into the waste toner container 62 of the station 10. The collecting operation of the secondary transfer remaining toner will be described in detail hereinafter.

The recording material P after the secondary transfer process is conveyed to the fixing device 7, subjected to a fixing process of the toner image, and ejected as image forming matter (print, copy) to the outside of the image forming apparatus 100A. When various sensors (not shown) detect that the image forming matter has normally been ejected to the outside of the image forming apparatus 100A, the image forming apparatus 100A stops the operation of each driving device and is returned to the standby mode.

(2-2) Monochromatic Mode

Subsequently, the image forming operation in the monochromatic mode (monochromatic image forming mode) in which a monochromatic image can be formed by using the single specific station will be described.

In the embodiment, the image forming apparatus 100A has the monochromatic mode in which a black and white image can be formed as a monochromatic image by using only the fourth station 10*d* for the K color.

The fundamental image forming operation in the monochromatic mode is similar to that in the foregoing full-color mode except that there are stations which do not form the toner images. However, the collecting operation of the secondary transfer remaining toner in the full-color mode and that in the monochromatic mode are different as will be described in detail hereinafter.

Further describing, when a print command of the monochromatic print is received in the standby mode, the image forming apparatus 100A starts the image forming operation in the monochromatic mode and starts the driving of each driving device, the activation of the exposure device 3, the activation of the fixing device 7, and the high voltage applying sequence.

In the embodiment, in the monochromatic mode, the developing devices 4*a* to 4*c* of the first to third stations 10*a* to 10*c* as stations for the colors of Y, M, and C are held in a state where they are away from the photosensitive drums 1*a* to 1*c*, respectively. In the monochromatic mode, the developing device 4*d* only in the fourth station 10*d* as a station for the K color comes into contact with the photosensitive drum 1*d*. Thus, only in the fourth station 10*d*, the exposure device 3*d* visualizes the electrostatic image as a toner image which is drawn on the photosensitive drum 1*d*. However, in the embodiment, the photosensitive drums 1*a* to 1*d* execute the rotating operation in all of the four stations 10*a* to 10*d*.

[Collection of Secondary Transfer Remaining Toner]

(1) Outline of Collecting Operation of Secondary Transfer Remaining Toner

The collecting operation of the secondary transfer remaining toner will now be described.

Generally, it is an object of the embodiment that in the image forming apparatus of the tandem system which collects the secondary transfer remaining toner by a system of collecting the toner simultaneously with the transfer, the transfer remaining toner on the intermediate transfer member is desirably collected. It is one of the more detailed objects of the embodiment that in the image forming apparatus of the tandem system which collects the secondary transfer remaining toner by the system of collecting the toner simultaneously with the transfer, the transfer remaining toner is more efficiently distributed to a plurality of waste toner containers and collected. It is another one of the more detailed objects of the embodiment that in the image forming apparatus of the tandem system as a system of collecting the toner simultaneously with the transfer, the waste toner container of each station can be economically used irrespective of a using ratio of each station, that is, a using ratio of the full-color mode and the monochromatic mode.

In the embodiment, according to the image forming apparatus 100A, the toner on the intermediate transfer belt 50 charged to the opposite polarity is reversely transferred from the intermediate transfer belt 50 onto one of the photosensitive drums 1 of a plurality of stations 10 and collected into the waste toner container of the station 10. The reverse transfer can be executed simultaneously with the primary transfer. The full-color mode (first image forming mode) in which the toner images are formed in all of a plurality of stations 10*a* to 10*d* and the monochromatic mode (second image forming mode) in which the toner image is formed in the specific single station 10*d* can be executed. The specific station 10*d* for forming the toner image in the monochromatic mode is a station other than the uppermost-stream station 10*a* in the moving direction of the surface of the intermediate transfer belt 50.

In the embodiment, the station which mainly collects the toner by the reverse transfer among a plurality of stations 10 in the full-color mode and that in the monochromatic mode differ. In the full-color mode, at least a part of the toner (on the intermediate transfer belt 50) which has been charged to the opposite polarity and reaches the primary transfer portion N1*a* of the uppermost-stream station 10*a* after completion of the primary transfer in the uppermost-stream station 10*a* is collected as follows.

That is, after the toner passed through the primary transfer portion N1*a* of the uppermost-stream station 10*a*, it is collected by the reverse transfer in the station other than the uppermost-stream station 10*a*.

(2) Details of Collecting Operation of Secondary Transfer Remaining Toner (2-1) Collecting Operation of Secondary Transfer Remaining Toner in Full-Color Mode First, the collecting operation of the secondary transfer remaining toner in the full-color mode will now be described.

Figure 3:
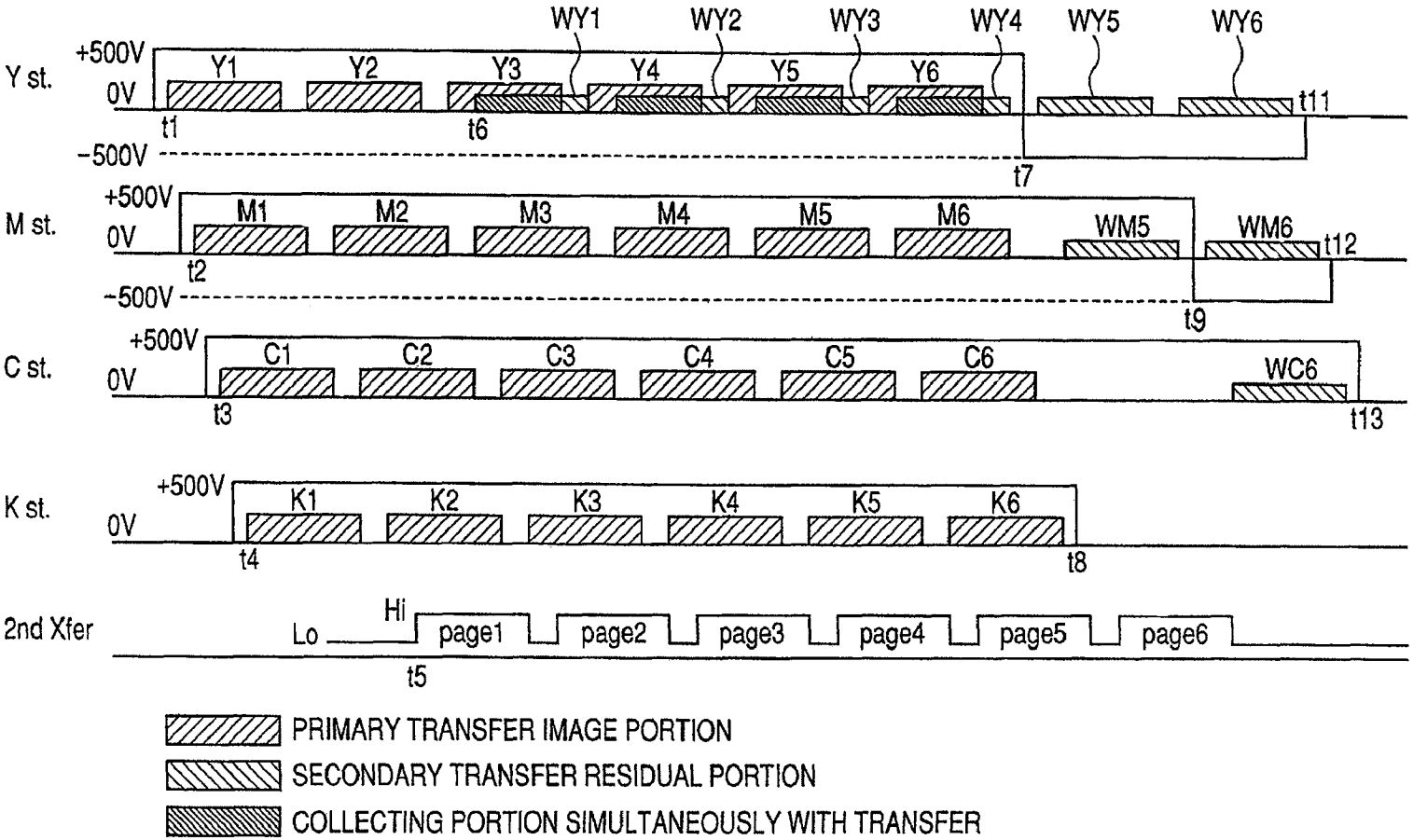
FIG. 3 is a timing chart for describing the collecting operation of secondary transfer remaining toner.

FIG. 3 illustrates a timing chart for specifically describing the operation in the full-color mode. In FIG. 3, an axis of abscissa denotes time. In FIG. 3, lines of Yst., Mst., Cst., and Kst. denote the operations (specifically speaking, biases which are applied to the primary transfer rollers 51*a* to 51*d*) of the primary transfer portions N1*a* to N1*d* of the first to fourth stations 10*a* to 10*d*, respectively. In FIG. 3, a line of 2nd Xfer denotes the operation (specifically speaking, a bias which is applied to the secondary transfer roller 52) of the secondary transfer portion N2. FIG. 3 illustrates an example with respect to the case where six images are continuously printed by the print command (one job) of once.

An output of the bias which is applied to the primary transfer roller 51*a* of the first station 10*a* is turned on at timing which is sufficiently before the toner image reaches the primary transfer portion N1*a* (desirably, before the timing corresponding to one circumference of the photosensitive drum 1). At this time, the bias which is applied to the primary transfer roller 51*a* is set to the voltage level during the image forming, that is, +500 V as an ordinary bias for the primary transfer (primary transfer voltage). Similarly, also in the second to fourth stations 10*b* to 10*d*, outputs of the biases which are applied to the primary transfer rollers 51*b* to 51*d* are sequentially turned on. At this time, the biases which are applied to the primary transfer rollers 51*b* to 51*d* are set to +500 V as an ordinary bias for the primary transfer.

After that, the toner image formed by the developing unit 4*a* of the first station 10*a* is primarily transferred to the intermediate transfer belt 50. In FIG. 3, Y1 denotes a period during which the first toner image formed by the first station 10*a* is primarily transferred to the intermediate transfer belt 50 from the photosensitive drum 1*a*. Y2, Y3, Y4, Y5, and Y6 denote periods during which the second to sixth toner images formed by the first station 10*a* are primarily transferred, respectively. This is true of M1 to M6 regarding the second station 10*b*, C1 to C6 regarding the third station 10*c*, and K1 to K6 regarding the fourth station 10*d*. An alphanumeric character of the first character indicates the color of the station and the second numeral indicates the number of designated toner image.

The output of the bias which is applied to the secondary transfer roller 52 shown by the line of 2nd Xfer is alternately changed between the Lo (low) level and the Hi (high) level. Lo indicates a state where a relatively low bias (in the embodiment, +1000 V) in the case where the recording material P does not exist in the secondary transfer portion N2 is output. Hi indicates a state where a relatively high bias (in the embodiment, +1500 V) in the case where the recording material P exists in the secondary transfer portion N2 is output. In FIG. 3, page1 to page6 denote periods during which the first to sixth toner images are secondarily transferred onto the recording material P, respectively.

Time t1 denotes time when the primary transfer of the first toner image onto the intermediate transfer belt 50 is started in the primary transfer portion N1*a* of the first station 10*a*. On the intermediate transfer belt 50, a front edge of the toner image is moved to the primary transfer portion N1*b* of the second station 10*b* for a time interval from time t1 to time t2. At time t2, the toner image of the M color is started to be overlappingly primarily transferred onto the toner image of the Y color.

Similarly, time t3 and t4 denote time when the front edge of the first toner image formed on the intermediate transfer belt 50 reaches the primary transfer portions N1*c* and N1*d* of the third and fourth stations 10*c* and 10*d*, respectively.

Time t5 denotes time when the toner image on the intermediate transfer belt 50 reaches the secondary transfer portion N2 and the secondary transfer of the toner image onto the recording material P is started.

Time t6 denotes time when the secondary transfer remaining toner of the first toner image is subjected to the charging process in the toner charge roller 58 and, thereafter, reaches the primary transfer portion N1*a* of the first station 10*a*. That is, the intermediate transfer belt 50 rotates by one circumference for a time interval from time t1 to time t6. In other words, the time interval from time t1 to time t6 is equal to a time which is required until the primarily transferred toner image is circulated as secondary transfer remaining toner and returned to the primary transfer portion N1 of the same station.

In FIG. 3, WY1 denotes a period of time during which the secondary transfer remaining toner of the first toner image passes through the primary transfer portion N1*a* of the first station 10*a*. WY2, WY3, WY4, WY5, and WY6 denote periods of time during which the secondary transfer remaining toner of the second to sixth toner image pass through the primary transfer portion N1*a* of the first station 10*a*, respectively. This is true of the second and third stations 10*b* and 10*c*. W of the first character denotes the secondary transfer remaining toner, an alphanumeric character of the second character indicates the color of the station, and a numeral of the third character indicates to which number of designated toner image the secondary transfer remaining toner belongs.

While the secondary transfer remaining toner is passing through the primary transfer portion N1, if the bias of the same polarity (in the embodiment, positive polarity) as that of the secondary transfer remaining toner charged to the opposite polarity is applied to the primary transfer portion N1, the secondary transfer remaining toner is reversely transferred to the photosensitive drum 1 of the station 10.

For example, in the period Y3 in FIG. 3, while the toner image formed on the photosensitive drum 1 is primarily transferred to the intermediate transfer belt 50, the secondary transfer remaining toner charged to the polarity opposite to the normal polarity is moved to the primary transfer portion N1. At this time, the secondary transfer remaining toner which exists on the intermediate transfer belt 50 and has been charged to the polarity opposite to the normal polarity and the toner (existing on the photosensitive drum 1) which has been charged to the normal polarity and which should be primarily transferred are hardly electrically neutralized in the nip portion between the photosensitive drum 1 and the intermediate transfer belt 50. Therefore, for example, the toner (on the photosensitive drum 1*a*) charged to the normal polarity in the period Y3 is moved to the intermediate transfer belt 50 and the toner (on the intermediate transfer belt 50) charged to the opposite polarity in the period WY1 is moved to the photosensitive drum 1*a*. In this manner, the toner (on the photosensitive drum 1) to be primarily transferred and the secondary transfer remaining toner on the intermediate transfer belt 50 are independently moved and collected simultaneously with the transfer. This is true of the other periods during which the primary transfer process and the collecting process of the secondary transfer remaining toner overlap, that is, the period Y4 and the period WY2, the period Y5 and the period WY3, and the period Y6 and the period WY4, respectively.

In the embodiment, at time t7 after the secondary transfer remaining toner of the fourth toner image passed through the primary transfer portion N1*a* of the first station 10*a*, the bias which is applied to the primary transfer roller 51*a* of the first station 10*a* is switched to −500 V. That is, at time t7 just after the elapse of the period WY4, the bias which is applied to the primary transfer roller 51*a* of the first station 10*a* is switched. In the embodiment, at time t7, the bias which is applied to the primary transfer roller 51*a* of the first station 10*a* is switched from the bias of the polarity opposite to the normal polarity of the toner to the bias of the same polarity as the normal charge polarity of the toner.

The secondary transfer remaining toner of each of the periods WY1, WY2, WY3, and WY4 is reversely transferred to the photosensitive drum 1*a* by the primary transfer portion N1*a* of the first station 10*a* and collected into the waste toner container 62*a* of the first station 10*a*.

The secondary transfer remaining toner of the fifth and sixth toner images (that is, periods of WY5 and WY6) is hardly collected in the first station 10*a* but passes through the primary transfer portion N1*a* of the first station 10*a* and is transported to the primary transfer portion N1*b* of the second station 10*b*.

In a period WM5 during which the secondary transfer remaining toner of the fifth toner image is passing through the primary transfer portion N1*b* of the second station 10*b*, the bias for the ordinary primary transfer (primary transfer voltage) is applied to the primary transfer roller 51*b* of the second station 10*b*. Therefore, most of the whole amount of secondary transfer remaining toner of the period WM5 is collected in the second station 10*b*.

Subsequently, at time t9 after the secondary transfer remaining toner of the fifth toner image passed through the primary transfer portion N1*b* of the second station 10*b*, the bias which is applied to the primary transfer roller 51*b* of the second station 10*b* is switched to −500 V. That is, at time t9 just after the elapse of the period WM5, the bias which is applied to the primary transfer roller 51*b* of the second station 10*b* is switched. In the embodiment, at time t9, the bias which is applied to the primary transfer roller 51*b* of the second station 10*b* is switched from the bias of the polarity opposite to the normal polarity of the toner to the bias of the same polarity as the normal charge polarity of the toner.

The secondary transfer remaining toner of the sixth toner image (that is, period of WM6) is hardly collected in the second station 10*b* but passes through the primary transfer portion N1*b* of the second station 10*b* and is transported to the primary transfer portion N1*c* of the third station 10*c*.

In a period WC6 during which the secondary transfer remaining toner of the sixth toner image is passing through the primary transfer portion N1*c* of the third station 10*c*, the bias for the ordinary primary transfer is applied to the primary transfer roller 51*c* of the third station 10*c*. Therefore, most of the whole amount of secondary transfer remaining toner of the period WC6 is collected into the third station 10*c*.

The biases which are applied to the primary transfer rollers 51*a* to 51*d* of the first to fourth stations 10*a* to 10*d* are turned off at t11, t12, t13, and t8, respectively. That is, in the first station 10*a*, after the bias which is applied to the primary transfer roller 51*a* was switched at time t7 as mentioned above, the bias is turned off at time t11 just after the elapse of the period WY6. In the second station 10*b*, after the bias which is applied to the primary transfer roller 51*b* was switched at time t9 as mentioned above, the bias is turned off at time t12 just after the elapse of the period WM6. In the third station 10*c*, the bias which is applied to the primary transfer roller 51*c* is not switched but is turned off at time t13 just after the elapse of the period WC6. In the embodiment, in the full-color mode, in the first to third stations 10*a* to 10*c*, substantially the whole secondary transfer remaining toner is collected. Therefore, in the fourth station 10*d*, the bias which is applied to the primary transfer roller 51*d* is turned off at time t8 just after the elapse of a period K6 during which the sixth toner image of the K color is primarily transferred from the photosensitive drum 1*d* to the intermediate transfer belt 50.

Figure 4:
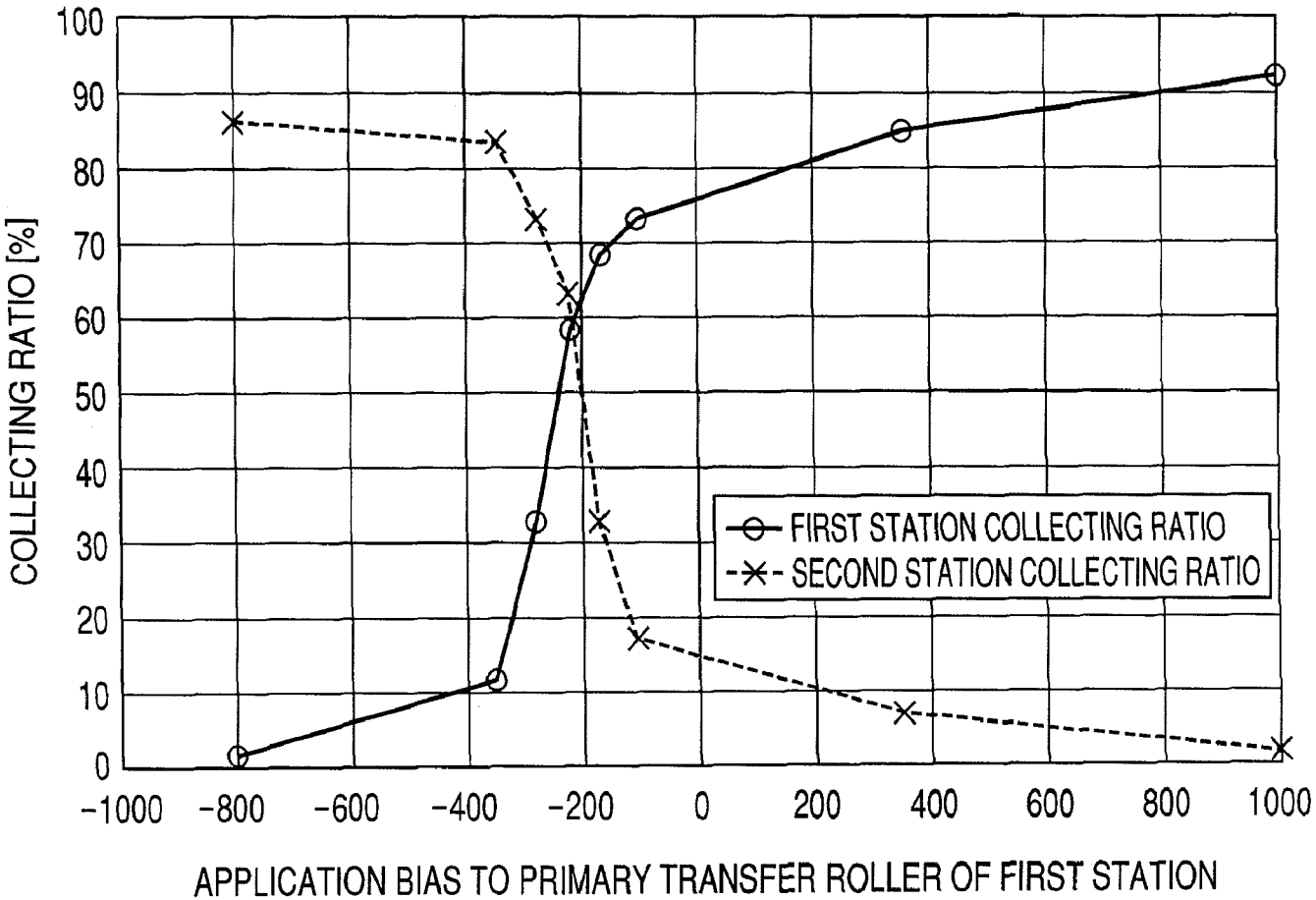
FIG. 4 is a graph illustrating an example of a collecting ratio of the toner.

FIG. 4 illustrates a relation between an application voltage and a collecting ratio in the primary transfer portion. An axis of abscissa in FIG. 4 indicates the voltage value of the bias which is applied to the primary transfer roller 51*a* of the first station 10*a*. An axis of ordinate in FIG. 4 indicates the collecting ratio by a percentage.

A solid line in FIG. 4 illustrates the collecting ratio of the first station 10*a* at the time when the voltage which is applied to the primary transfer roller 51*a* of the first station 10*a* is changed. The collecting ratio of the first station 10*a* is defined as follows. That is, in the moving direction of the surface of the intermediate transfer belt 50, a weight of the secondary transfer remaining toner existing on the intermediate transfer belt 50 in front of the primary transfer portion N1*a* of the first station 10*a* is assumed to be $\alpha$. A weight of the secondary transfer remaining toner transferred to the photosensitive drum 1*a* of the first station 10*a* after the portion on the intermediate transfer belt 50 passed through the primary transfer portion N1*a* of the first station 10*a* is assumed to be $\beta$. At this time, the collecting ratio of the first station 10*a* is a weight ratio which is expressed by the following expression.

$$(\beta/\alpha)\times 100$$

A broken line in FIG. 4 illustrates the collecting ratio of the second station 10*b* at the time when the voltage which is applied to the primary transfer roller 51*a* of the first station 10*a* is changed. The collecting ratio of the second station 10*b* is defined as follows. That is, in the moving direction of the surface of the intermediate transfer belt 50, the weight of the secondary transfer remaining toner existing on the intermediate transfer belt 50 before the primary transfer portion N1*a* of the first station 10*a* is assumed to be $\alpha$. A weight of the secondary transfer remaining toner transferred to the photosensitive drum 1*b* of the second station 10*b* after the portion on the intermediate transfer belt 50 passed through the primary transfer portion N1*b* of the second station 10*b* is assumed to be $\gamma$. At this time, the collecting ratio of the second station 10*b* is a weight ratio which is expressed by the following expression.

$$(\gamma/\alpha)\times 100$$

When executing such experiments, surface potentials (charge potentials) of the photosensitive drums 1*a* and 1*b* of the first and second stations 10*a* and 10*b* are set to a constant value of −500 V. The bias which is applied to the primary transfer roller 51*b* of the second station 10*b* is fixed to +500 V. A voltage obtained by superimposing the DC voltage of +500 V to the AC voltage in which a frequency is equal to 1 kHz and a voltage between peaks is equal to 1800 V is applied to the toner charge roller 58.

When the bias which is applied to the primary transfer roller 51*a* of the first station 10*a* reaches −500 V or less (for example, −800 V), the collection of the secondary transfer remaining toner in the first station 10*a* is not performed. Most of the whole amount of the secondary transfer remaining toner passes through the primary transfer portion N1*a* of the first station 10*a*. That is, if the bias which is applied to the primary transfer roller 51*a* is equal to −500 V or a bias on the negative polarity side than it, the collection of the secondary transfer remaining toner in the first station 10*a* is not performed. Most of the whole amount of the secondary transfer remaining toner passes through the primary transfer portion N1*a* of the first station 10*a*.

When the bias which is applied to the primary transfer roller 51*a* is higher than −500 V as a surface potential of the photosensitive drum 1*a*, an electric field in such a direction as to move the toner of the positive polarity from the intermediate transfer belt 50 onto the photosensitive drum 1*a* occurs between the primary transfer roller 51*a* and the photosensitive drum 1*a*. That is, if the bias which is applied to the primary transfer roller 51*a* is a bias on the positive polarity side than −500 V, an electric field in such a direction as to move the toner of the positive polarity from the intermediate transfer belt 50 onto the photosensitive drum 1*a* occurs between the primary transfer roller 51*a* and the photosensitive drum 1*a*. This electric field is a positive electric field from the primary transfer roller 51*a* to the photosensitive drum 1*a*. By this electric field, the reverse transfer of the secondary transfer remaining toner uniformly charged to the charge polarity of the positive polarity from the intermediate transfer belt 50 onto the photosensitive drum 1*a* starts and the collection in the first station 10*a* starts.

If the bias which is applied to the primary transfer roller 51*a* of the first station 10*a* lies within a range from −300 V to −100 V, a part of the secondary transfer remaining toner passes through the primary transfer portion N1*a* of the first station 10*a*.

A sum of the collecting ratio of the first station 10*a* and the collecting ratio of the second station 10*b* is almost close to 100% irrespective of the bias which is applied to the primary transfer roller 51*a* of the first station 10*a*. Therefore, for example, the bias which is applied to the primary transfer roller 51*b* of the second station 10*b* is set to +500 V irrespective of the bias which is applied to the primary transfer roller 51*a* of the first station 10*a*. Thus, most of the whole amount of the secondary transfer remaining toner which has passed through the primary transfer portion N1*a* of the first station 10*a* is collected in the second station 10*b*.

As mentioned above, desirably, by setting the bias which is applied to the primary transfer roller to the surface potential of the photosensitive drum or the electric potential on the normal charge polarity side of the toner from the surface potential of the photosensitive drum, the collection of the secondary transfer remaining toner in the relevant station can be suppressed. In other words, by setting the bias which is applied to the primary transfer roller to a value that is equal to the surface potential of the photosensitive drum or by setting a voltage difference between the surface potential of the photosensitive drum and the bias which is applied to the primary transfer roller to the same polarity as that of the toner, the collection of the secondary transfer remaining toner in the relevant station can be suppressed. Therefore, such a situation that the secondary transfer remaining toner is concentratedly collected to the specific station can be suppressed. Thus, an uneconomical property which is caused by the frequent exchange and is liable to be remarkable for the cartridge of the first station 10*a* can be lightened.

For example, a case where the bias which is applied to the primary transfer roller 51*a* is set to −200 V and the collecting ratio of the first station 10*a* is set to a value near 50% will now be considered. In this case, a ratio of an amount of secondary transfer remaining toner which is collected and an amount of the transfer remaining toner which passes is liable to be changed due to many factors such as amount of charged charges of the secondary transfer remaining toner, a temperature and a humidity of a peripheral environment where the image forming apparatus is provided, using history of the process cartridge, and the like. That is, if the collecting ratio of each station is adjusted by holding the secondary transfer remaining toner while making the bias which is applied to the primary transfer roller 51 different at every station, the collecting ratio is liable to change depending to the environment.

In the collecting ratio near 0% and 100%, an influence which is exerted on the collecting ratio by fluctuation factors as mentioned above is small. As mentioned above, desirably, the bias which is applied to the primary transfer roller is set to the value that is equal to the surface potential of the photosensitive drum or to a value on the normal charge polarity side of the toner from the surface potential of the photosensitive drum. In other words, the voltage difference between the surface potential of the photosensitive drum and the bias which is applied to the primary transfer roller is set to almost zero or the same polarity as that of the toner. Thus, the secondary transfer remaining toner can be made to pass relatively stably while escaping an intermediate region where a reverse transfer amount becomes unstable.

To stabilize the collecting ratio, it is much desirable to use a method whereby a bias condition in which most of the whole amount of toner is stably collected and a bias condition in which most of the whole amount of secondary transfer remaining toner can be allowed to stably pass are switched according to a time. That is, by adjusting a collection amount by controlling a ratio of a collecting time and a passing time, a ratio of the passage and the collection can be much precisely controlled.

In the embodiment, the secondary transfer remaining toner of an amount corresponding to about four of output images is collected to the first station 10*a*, the secondary transfer remaining toner of an amount corresponding to one output image is collected to the second station 10*b*, and the secondary transfer remaining toner of an amount corresponding to one output image is collected to the third station 10*c*, respectively. The collecting ratio is hardly changed by the fluctuation factors such as a peripheral environment and the like as mentioned above.

When the bias which is applied to the primary transfer roller is changed during the primary transfer process of the toner image, a transfer efficiency of the toner which is transferred from the photosensitive drum to the intermediate transfer belt fluctuates and it becomes a factor of causing a concentration variation or a concentration level difference on the image or a defective image like a lateral stripe, so that it is undesirable. If the bias which is applied to the primary transfer roller 51*a* is not changed until the whole secondary transfer remaining toner has passed through the primary transfer portion N1*a* of the first station 10*a*, the secondary transfer remaining toner is biased and collected to the first station 10*a*. If the secondary transfer remaining toner is not collected in any of the four stations but is allowed to pass, it is circulated on the intermediate transfer belt 50 and reaches the secondary transfer roller 52. Therefore, since the secondary transfer roller 52 is polluted by the secondary transfer remaining toner which is in contact with the secondary transfer roller 52 and there is a possibility that the back surface of the recording material P becomes dirty upon next printing, it is undesirable.

In the embodiment, therefore, the bias which is applied to the primary transfer roller 51*a* is changed when the primary transfer of the toner image is not executed in the first station 10*a* and before the whole secondary transfer remaining toner passes through the primary transfer portion N1*a* of the first station 10*a*. As mentioned above, in this instance, the bias which is applied to the primary transfer roller 51*a* of the first station 10*a* is changed in the direction from the bias for the ordinary primary transfer to the same polarity as the normal charge polarity of the toner (in the embodiment, to the minus side, that is, in such a direction as to reduce the voltage). The secondary transfer remaining toner which has passed through the primary transfer portion N1*a* of the first station 10*a* is not circulated on the intermediate transfer belt 50 but is collected in any of the stations 10 after that. In the embodiment, the secondary transfer remaining toner is collected in the second and third stations 10*b* and 10*c*, respectively. Therefore, the collection of the secondary transfer remaining toner in the first station 10*a* can be suppressed while maintaining image quality. Thus, it is prevented that the secondary transfer remaining toner is concentratedly collected in the specific station and the uneconomical property which is caused by the frequent exchange and is liable to be remarkable for the cartridge of the first station 10*a* can be lightened.

Figure 5:
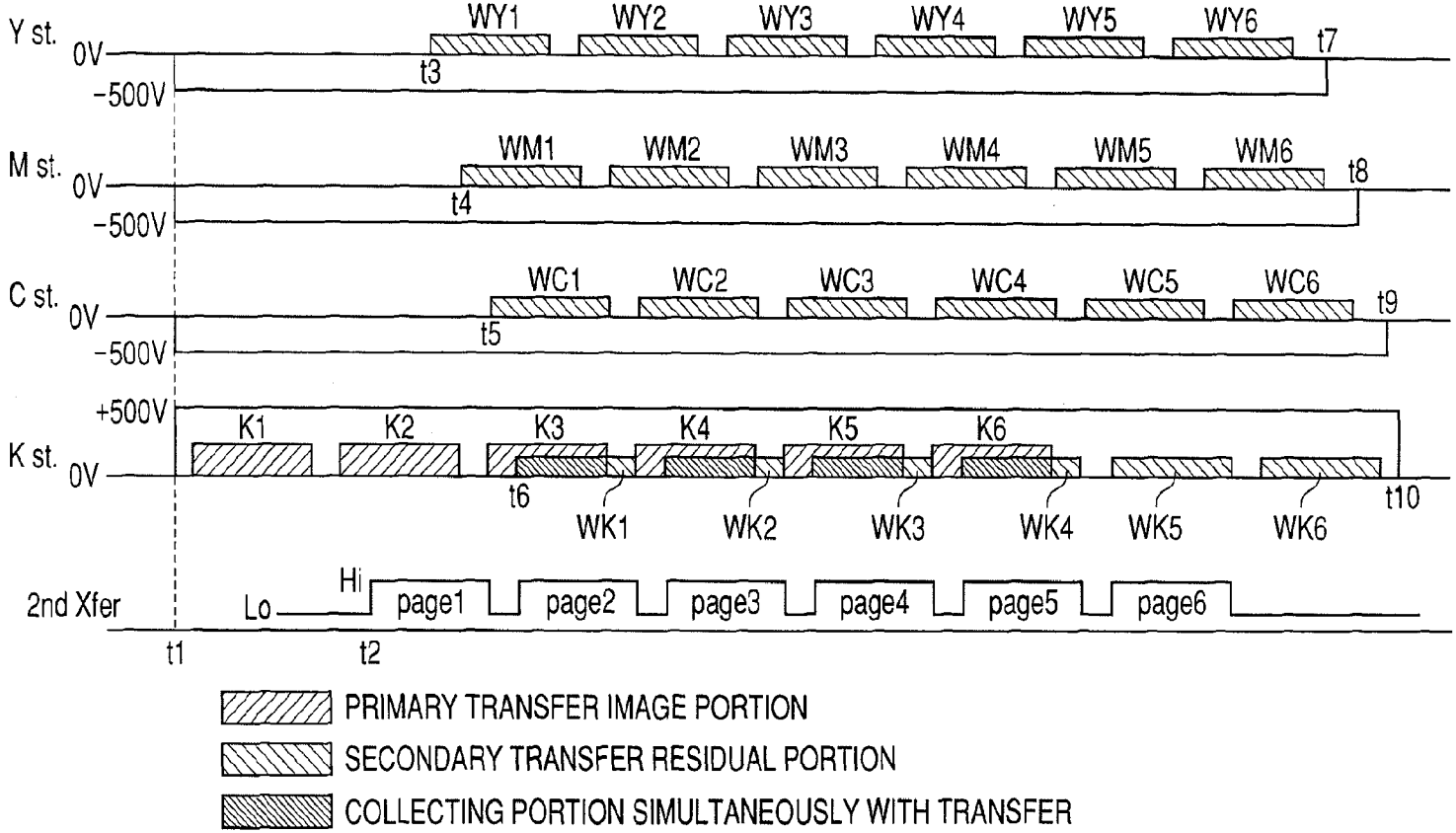
FIG. 5 is a timing chart for describing the collecting operation of the secondary transfer remaining toner.

(2-2) Collecting Operation of Secondary Transfer Remaining Toner in Monochromatic Mode FIG. 5 illustrates a timing chart for specifically describing the operation in the monochromatic mode. FIG. 5 illustrates the timing when six images are continuously printed in the monochromatic mode by the print command (one job) of once. Reference numerals in FIG. 5 fundamentally have the same meanings as those of the reference numerals in FIG. 3 (however, t1 to t10 denote different time).

In the monochromatic mode, only the fourth station 10*d* as a station for the K color executes the image forming. In the monochromatic mode, it is unnecessary to overlap the toner images and the image forming by the fourth station 10*d* starts without waiting until the toner image of the first station 10*a* reaches the fourth station 10*d*. Therefore, a time which is necessary to print the first one image (time until the recording material P is ejected after a print signal was received) can be shortened and there is such an advantage that the productivity of images can be improved. In particular, such an effect is largest in the case where the station 10*d* which forms the image in the monochromatic mode (in the embodiment, station 10*d* for the K color) is set to the downmost-stream station in the moving direction of the surface of the intermediate transfer belt 50.

At time t1, in the fourth station 10*d*, the application of the bias of +500 V is started to the primary transfer roller 51*d*. At the same time, in the first to third stations 10*a* to 10*c*, the application of the bias of −500 V is started to the primary transfer rollers 51*a* to 51*c*.

After that, the first toner image reaches the primary transfer portion N1*d* on the photosensitive drum 1*d* of the fourth station 10*d* and is primarily transferred onto the intermediate transfer belt 50 in the period K1. Similarly, in the periods K2 to K6, the second to sixth toner images are primarily transferred onto the intermediate transfer belt 50 in the primary transfer portion N1*d* of the fourth station 10*d*, respectively.

In the period WY1 during which the secondary transfer remaining toner of the first toner image passes through the primary transfer portion N1*a* of the first station 10*a*, the bias which is applied to the primary transfer roller 51*a* of the first station 10*a* is equal to −500 V. Therefore, the secondary transfer remaining toner is not collected in the first station 10*a* but most of the whole amount of the toner passes through the primary transfer portion N1*a* of the first station 10*a*. Similarly, also in each of the periods WY2 to WY6, most of the whole amount of the secondary transfer remaining toner passes through the primary transfer portion N1*a* of the first station 10*a*.

The bias of −500 V has also been applied to the primary transfer rollers 51*b* and 51*c* of the second and third stations 10*b* and 10*c*. Therefore, the secondary transfer remaining toner of the six toner images is hardly collected in the first to third stations 10*a* to 10*c* and reaches in the primary transfer portion N1*d* of the fourth station 10*d*.

In the fourth station 10*d*, the secondary transfer remaining toner in the periods WK1 to WK4 is reversely transferred to the photosensitive drum 1*d* simultaneously with the primary transfer (periods K3 to K6) of the third to sixth toner images. Also in the periods WK5 and WK6, since the bias which is applied to the primary transfer roller 51*d* of the fourth station 10*d* is held in the same bias of +500 V as the bias for the ordinary primary transfer, the secondary transfer remaining toner is reversely transferred to the photosensitive drum 1*d*. Thus, substantially the whole secondary transfer remaining toner of the six toner images is collected into the waste toner container 62*d* of the fourth station 10*d*.

The biases which are applied to the primary transfer rollers 51*a* to 51*d* of the first to fourth stations 10*a* to 10*d* are turned off at t7, t8, t9, and t10, respectively. That is, in the first station 10*a*, the bias which is applied to the primary transfer roller 51*a* is turned off at time t7 just after the elapse of the period WY6. In the second station 10*b*, the bias which is applied to the primary transfer roller 51*b* is turned off at time t8 just after the elapse of the period WM6. In the third station 10*c*, the bias which is applied to the primary transfer roller 51*c* is turned off at time t9 just after the elapse of the period WC6. In the fourth station 10*d*, the bias which is applied to the primary transfer roller 51*d* is turned off at time t10 just after the elapse of the period WK6.

As mentioned above, in the embodiment, in the full-color mode, in the first and second stations 10*a* and 10*b*, the following electric fields are switched and produced between the photosensitive drum 1 and the intermediate transfer belt 50. The first one of them is an electric field (first electric field) in such a direction that the toner of the first polarity as a normal charge polarity of the toner is moved from the photosensitive drum 1 onto the intermediate transfer belt 50 and the toner of the second polarity as a polarity opposite to the first polarity is moved from the intermediate transfer belt 50 onto the photosensitive drum 1. The second one of them is an electric field (second electric field) in such a direction that the toner of the first polarity is moved from the intermediate transfer belt 50 onto the photosensitive drum 1 and the toner of the second polarity as a polarity opposite to the first polarity is moved from the photosensitive drum 1 onto the intermediate transfer belt 50. The first electric field and the second electric field are the electric fields of the opposite directions. The first electric field is an electric field in the same direction as that upon primary transfer and is an electric field in such a direction that the toner charged to the polarity opposite to the normal charge polarity is reversely transferred to the photosensitive drum 1 by the primary transfer portion. The second electric field is an electric field in such a direction that the toner charged to the polarity opposite to the normal charge polarity is allowed to pass through the primary transfer portion. Particularly, in the embodiment, the first electric field and the second electric field are switched by changing the polarity of the bias which is output from the primary transfer bias power supply 56 to the primary transfer roller 51. In the full-color mode, in the third and fourth stations 10*c* and 10*d*, the first electric field is formed.

In the monochromatic mode, in the first to third stations 10*a* to 10*c*, the second electric field is formed. Particularly, in the embodiment, the second electric field is formed by changing the polarity of the bias which is output from the primary transfer bias power supply 56 to the primary transfer roller 51 from the polarity upon primary transfer in the full-color mode. In the monochromatic mode, in the fourth station 10*d*, the first electric field is formed.

That is, in the embodiment, the primary transfer bias power supplies 56*a* to 56*c* of at least the first to third stations 10*a* to 10*c* can form the first electric field and the second electric field. Particularly, in the embodiment, the primary transfer bias power supplies 56*a* to 56*c* of at least the first to third stations 10*a* to 10*c* have a switching unit for switching the polarities of the biases which are output to the primary transfer rollers 51*a* to 51*c*, respectively.

Since the surface of the photosensitive drum 10 is insulative, it receives the charges of the abut-on member or the toner and the electric potential is liable to fluctuate unstably. Therefore, in the stations 10 which do not form any images, if the photosensitive drum 10 is in contact with the intermediate transfer belt 50 in a state where the charge bias and the exposure device 3 are off, the reverse transfer of the toner from the intermediate transfer belt 50 to the photosensitive drum 10 is liable to occur unstably.

In the state where the photosensitive drum 1 is in contact with the intermediate transfer belt 50, in such an abut-on portion, in order to allow the secondary transfer remaining toner to pass without reversely transferring the toner to the photosensitive drum 1, it is desirable to actively provide the following electric field between the photosensitive drum 1 and the intermediate transfer belt 50. That is, it is desirable to provide the electric field in such a direction that the toner charged to the polarity opposite to the normal charge polarity is moved from the surface of the photosensitive drum 1 toward the intermediate transfer belt 50. That is, in the embodiment, it is desirable to set the surface potential of the photosensitive drum 1 to the side of the polarity opposite to the normal charge polarity of the toner for the bias which is applied to the primary transfer roller 51. In other words, in the embodiment, it is desirable to set a difference between the surface potential of the photosensitive drum 1 and the bias which is applied to the primary transfer roller 51 to a plus value. In order to stably maintain such an electric field, it is desirable to stably control the electric potential of the photosensitive drum 1. Specifically speaking, the electric potential of the photosensitive drum 1 can be stabilized by applying a charge voltage to the charge roller 2 which comes into contact with the photosensitive drum 1 and/or exposing the photosensitive drum 1.

As mentioned above, desirably, even in the station 10 which is not concerned with the image forming in the monochromatic mode, the charge voltage is applied to the photosensitive drum 1 and/or the photosensitive drum 1 is exposed. Thus, the secondary transfer remaining toner can be allowed to stably pass through the primary transfer portion of the station 10 without being collected in such a station 10.

(2-3) Effects of the Embodiment

According to the embodiment as mentioned above, in the image forming apparatus of the tandem system in which the secondary transfer remaining toner is collected by the system of collecting the toner simultaneously with the transfer, the transfer remaining toner on the intermediate transfer member can be desirably collected. Particularly, according to the embodiment, in the image forming apparatus of the tandem system in which the secondary transfer remaining toner is collected by the system of collecting the toner simultaneously with the transfer, the transfer remaining toner can be more efficiently distributed and collected into a plurality of waste toner containers. According to the embodiment, in the image forming apparatus of the tandem system as a system of collecting the toner simultaneously with the transfer, the waste toner container of each station can be economically used irrespective of the using ratio of each station, that is, the using ratio of the full-color mode and the monochromatic mode.

That is, in the image forming apparatus of the related art, for example, in the case of continuously forming the images, the voltage of the positive polarity is continuously applied to the primary transfer roller of the first station during the primary transfer process. When the secondary transfer remaining toner subjected to the charging process reaches the primary transfer portion of the first station, the toner image on the photosensitive drum is moved to the intermediate transfer belt and the secondary transfer remaining toner on the intermediate transfer belt is reversely transferred onto the photosensitive drum. The reversely-transferred secondary transfer remaining toner is stored into the waste toner container of the first station. At this time, in the case of the full-color mode, most of the whole secondary transfer remaining toner of the colors of Y, M, C, and K is collected into the waste toner container of the first station. Also in the case of the monochromatic mode, similarly, most of the whole secondary transfer remaining toner of the K color is collected into the waste toner container of the first station. Therefore, there is a case where if the monochromatic mode is frequently used, in spite of the fact that a color image is not printed, the waste toner container of the first station is filled with the toner and a cartridge of the first station, for example, a yellow cartridge has to be exchanged.

On the other hand, according to the embodiment, the station mainly for collecting the secondary transfer remaining toner in the full-color mode and the station mainly for collecting the secondary transfer remaining toner in the monochromatic mode are made different. Thus, it is prevented that the secondary transfer remaining toner is concentratedly collected into the first station and the cartridges can be economically used.

According to the embodiment, in the monochromatic mode, the secondary transfer remaining toner is collected mainly by the station which forms the toner image in the monochromatic mode (in the embodiment, the fourth station for the K color). Therefore, in the monochromatic mode, it is suppressed that the secondary transfer remaining toner is collected into the station which forms the toner image only in the full-color mode, and the cartridge which is used only in the full-color mode can be economically used. Particularly, in the monochromatic mode, it is suppressed that the secondary transfer remaining toner is concentratedly collected into the first station which forms the toner image only in the full-color mode, and the cartridge of the first station which is used only in the full-color mode can be economically used.

When the toner image which has primarily been transferred onto the intermediate transfer belt passes through the primary transfer portion of the station existing on the downstream side in the rotating direction of the intermediate transfer belt, the intermediate transfer belt or the toner image and the photosensitive drum cause a discharge, so that there is a case where the toner whose charge polarity has been inverted is produced. Since a part of such toner is reversely transferred to the photosensitive drum, there is a case where the nearer the toner image on the intermediate transfer belt moves toward the station existing on the downstream side, the more the toner amount decreases. Such a phenomenon is called a retransfer.

The retransfer phenomenon can be caused not only by a discharge but also by a mechanically-adhered force between the toner and the photosensitive drum. In the first station, since there is no station on its upstream side, the retransferred toner is hardly collected. However, in the fourth station, the toner retransferred from the toner images formed by the first, second, and third stations are collected. That is, there is such a tendency that the nearer the position of the station is located on the downstream side, an amount of retransferred toner which is collected in the station increases.

As mentioned above, as a phenomenon peculiar to the tandem image forming apparatus which collects the secondary transfer remaining toner simultaneously with the transfer, there is such a tendency that the collection amounts of the waste toner in the first and fourth stations increase. The first station is the first station on the downstream side of the toner charge roller in the rotating direction of the intermediate transfer belt (first station in image forming order of the toner images in the full-color mode). The fourth station is the first station on the upstream side of the toner charge roller in the rotating direction of the intermediate transfer belt (last station in image forming order of the toner images in the full-color mode).

Therefore, in order to eliminate an unbalance of the collection amounts of the waste toner as mentioned above irrespective of the using ratio of the full-color mode and the monochromatic mode, it is desirable to distribute the secondary transfer remaining toner to each station.

As mentioned above, it is desirable to suppress such a situation that the cartridges of the stations which form the toner images only in the full-color mode has to be exchanged in use of only the station which forms the toner image in the monochromatic mode.

That is, in the full-color mode, when the collection is not executed simultaneously with the transfer (that is, when the primary transfer is not executed), it is desirable to collect the secondary transfer remaining toner by the station other than the first station and the station which forms the toner image in the monochromatic mode as much as possible. That is, if the station which forms the toner image in the monochromatic mode is the fourth station, in the full-color mode, when the collection is not executed simultaneously with the transfer, it is desirable to collect the secondary transfer remaining toner by the station other than the first and fourth stations.

Further, in the second and third stations, there is such a tendency that the collection amount of the toner by the third station due to the retransfer in the full-color mode is larger than that by the second station because of the foregoing reasons. Therefore, in order to keep a balance of the total waste toner amount of each station, with respect to the secondary transfer remaining toner, it is desirable to set the collection amount in the second station to be larger than the collection amount in the third station.

According to the embodiment, in the full-color mode, the secondary transfer remaining toner is collected by the station (in the embodiment, the fourth station for the K color) other than the station which forms the image in the monochromatic mode. Thus, it is suppressed that, in the full-color mode, the secondary transfer remaining toner is concentratedly collected to the station which forms the toner image in the monochromatic mode. The cartridge which is used in the monochromatic mode can be economically used. Further, according to the embodiment, when the primary transfer is not executed, the secondary transfer remaining toner is collected by the stations (in the embodiment, the second and third stations) other than the first station and the station which forms the toner image in the monochromatic mode as much as possible. Thus, the cartridges which are used in the full-color mode can be economically used.

As mentioned above, desirably, in the full-color mode, the secondary transfer remaining toner is collected by the stations other than the station which forms the toner image in the monochromatic mode and at the time other than the primary transfer time, the toner is collected by the stations other than the first station. Thus, it is suppressed that the secondary transfer remaining toner is concentratedly collected to the first station and the station which forms the toner image in the monochromatic mode. All of the cartridges can be economically used.

In the embodiment, in the monochromatic mode, in the stations other than the station which forms the image in the monochromatic mode, the voltage of the same polarity as the normal charge polarity of the toner is applied to the primary transfer roller. Desirably, in the monochromatic mode, in the stations other than the station which forms the image in the monochromatic mode, the bias which is applied to the primary transfer roller is set to the electric potential which is equal to the surface potential of the photosensitive drum or the electric potential on the normal charge polarity side of the toner from the surface potential of the photosensitive drum. In other words, in the monochromatic mode, in the stations other than the station which forms the image in the monochromatic mode, the difference between the surface potential of the photosensitive drum and the bias which is applied to the primary transfer roller is set to almost zero or to the same polarity as that of the toner. In this manner, control is made so that the secondary transfer remaining toner is not collected by the stations (in the embodiment, the first to third stations) which form the toner images only in the full-color mode. Most of the whole amount of the secondary transfer remaining toner is collected by the station (in the embodiment, the fourth station) which forms the toner image in the monochromatic mode. Thus, such a situation that volumes of the waste toner containers of the stations which form the toner images only in the full-color mode are reduced by executing the image forming in the monochromatic mode can be prevented. Therefore, such an inconvenience that in spite of the use only in the monochromatic mode, the waste toner container of the cartridge, for example, the cartridge for yellow which is used only in the full-color mode is filled with the toner and such a cartridge has to be exchanged can be suppressed.

Embodiment 2

Subsequently, another embodiment of the invention will be described. Fundamental construction and operation of an image forming apparatus of the embodiment are substantially the same as those of embodiment 1. Therefore, the component elements having the same or corresponding functions as those in the image forming apparatus 100A of embodiment 1 are designated by the same reference numerals and their detailed description is omitted.

Figure 6:
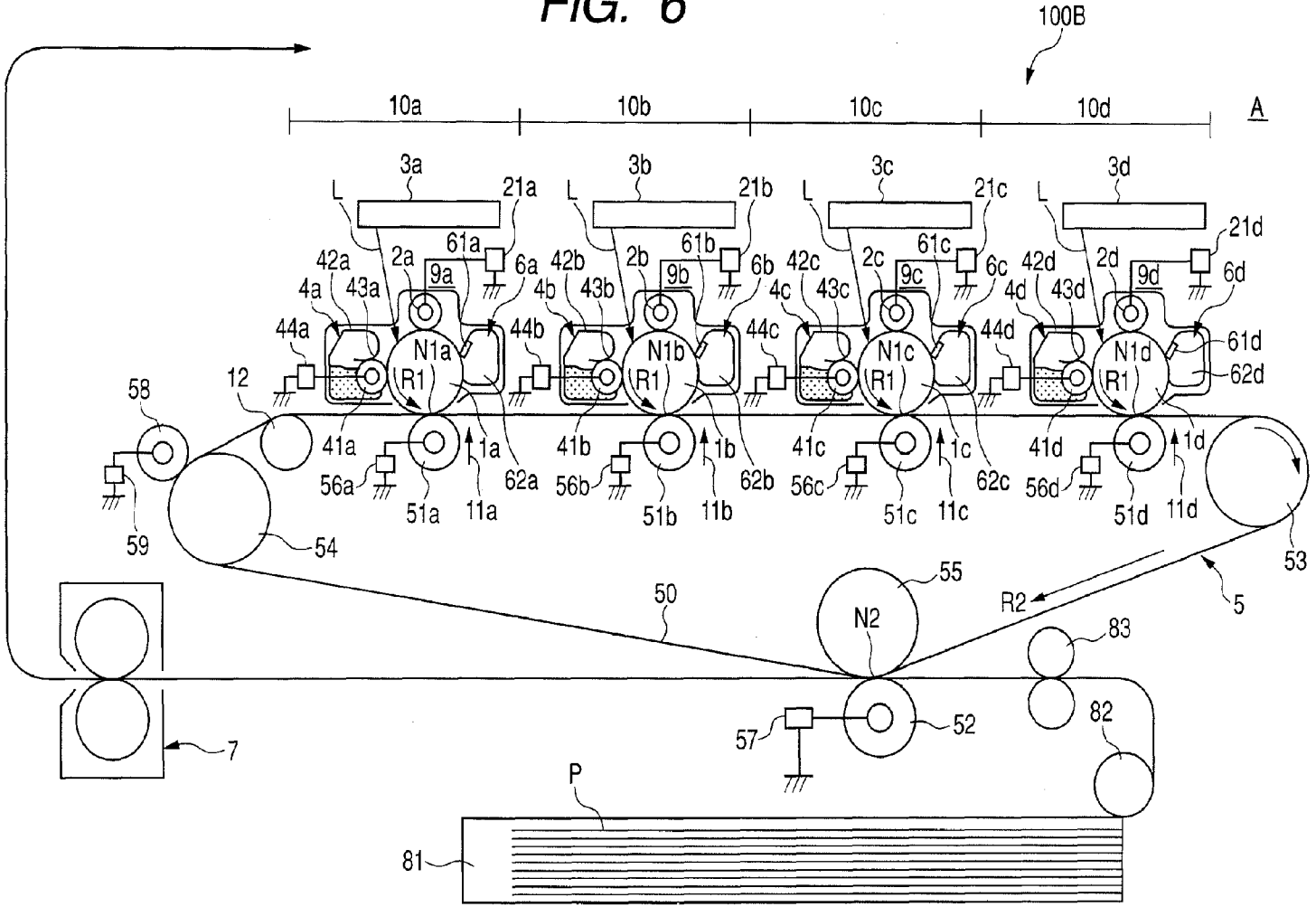
FIG. 6 is a schematic cross sectional constructional diagram of an image forming apparatus according to the second embodiment of the invention.

FIG. 6 shows a schematic cross sectional construction of an image forming apparatus 100B of the embodiment.

In the embodiment, the intermediate transfer belt 50 held in the intermediate transfer unit 5 is supported by four rollers of the driving roller 53, the tension roller 54, the secondary transfer opposing roller 55, and an abut-on/keep-off control roller 12.

In the full-color mode, the abut-on/keep-off control roller 12 is located at a position illustrated in FIG. 6. A state where the intermediate transfer belt 50 and the photosensitive drums 1*a* to 1*d* of the first to fourth stations 10*a* to 10*d* are pressed by the primary transfer rollers 51*a* to 51*d* and are in contact with each other is maintained. In the full-color mode, the apparatus operates according to a timing chart similar to that in embodiment 1.

Figure 7:
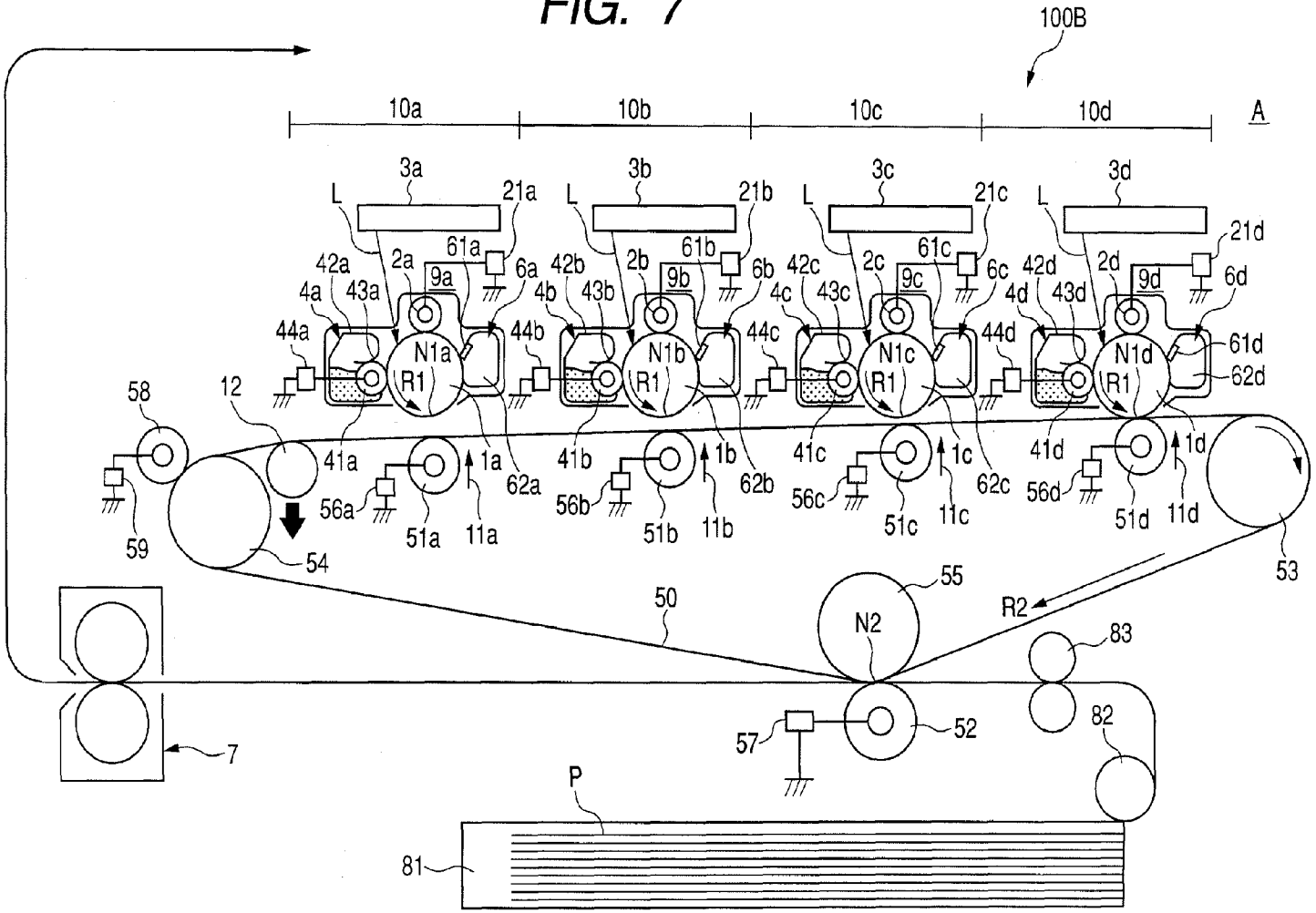
FIG. 7 is a schematic cross sectional constructional diagram illustrating a state where an intermediate transfer belt has been separated from photosensitive drums of first to third stations in the image forming apparatus according to the second embodiment of the invention.

In the monochromatic mode, the abut-on/keep-off control roller 12 is located at a position illustrated in FIG. 7. A state where the intermediate transfer belt 50 is separated from the photosensitive drums 1*a* to 1*c* of the first to third stations 10*a* to 10*c* and is in contact with the photosensitive drum 1*d* of the fourth station 10*d* is maintained.

Further describing, when the image forming apparatus 100B of the embodiment receives the print command in the monochromatic mode in the standby mode, the abut-on/keep-off control roller 12 is retracted from the position illustrated in FIG. 6 to a lower position in FIG. 7 by a movable unit (not shown). That is, from a position where the intermediate transfer belt 50 is urged from the inner peripheral side toward the outer peripheral side, the abut-on/keep-off control roller 12 is moved toward the inside of the intermediate transfer belt 50 so as to cancel the urging of the intermediate transfer belt 50. At this time, simultaneously with it, the primary transfer rollers 51*a* to 51*c* of the first to third stations 10*a* to 10*c* and the neutralization members (neutralization needles) 11*a* to 11*c* are interlockingly retracted to a lower position in the diagram. An abut-on/keep-off mechanism having the abut-on/keep-off control roller 12, its movable unit, the movable primary transfer rollers 51*a* to 51*c*, and the like is provided. The abut-on/keep-off mechanism changes the abut-on or keep-off state between the photosensitive drums 1*a* to 1*d* and the intermediate transfer belt 50 according to the full-color mode and the monochromatic mode. By this operation, the intermediate transfer belt 50 is separated from the photosensitive drums 1*a* to 1*c* of the first to third stations 10*a* to 10*c* and only the photosensitive drum 1*d* of the fourth station 10*d* is in contact with the intermediate transfer belt 50.

In the monochromatic mode, in the first to third stations 10*a* to 10*c*, the photosensitive drums 1*a* to 1*c* stop the rotating operation and the power supply to the charge rollers 2*a* to 2*c* and the developing rollers 41*a* to 41*c* is not executed but 0V is maintained. The developing rollers 41*a* to 41*c* maintain the state where they are away from the photosensitive drums 1*a* to 1*c*.

In the monochromatic mode, the secondary transfer remaining toner which is caused when, for example, the continuous printing has been executed is not come into contact with the photosensitive drums 1*a* to 1*c* of the first to third stations 10*a* to 10*c*. Therefore, the secondary transfer remaining toner is not reversely transferred to the photosensitive drums 1*a* to 1*c* but is circulated to the primary transfer portion N1*d* of the fourth station 10*d*. +500 V as a bias for the ordinary primary transfer is applied to the primary transfer roller 51*d* of the fourth station 10*d* until the whole secondary transfer remaining toner passes through the primary transfer portion N1*d*. Thus, substantially the whole secondary transfer remaining toner is reversely transferred to the photosensitive drum 1*d* of the fourth station 10*d* and is collected into the waste toner container 62*d* of the fourth station 10*d*.

By such an operation, in the monochromatic mode, control can be made more strictly so that the secondary transfer remaining toner is not collected by the stations (in the embodiment, the first to third stations) which form the toner images only in the full-color mode. By collecting most of the whole amount of the secondary transfer remaining toner by the station which forms the toner image in the monochromatic mode, such a situation that the volumes of the waste toner containers of the stations which form the toner images only in the full-color mode are reduced can be prevented. Therefore, such an inconvenience that in spite of the use only in the monochromatic mode, the waste toner container of the cartridge, for example, the cartridge for yellow which is used only in the full-color mode is filled with the toner and such a cartridge has to be exchanged can be suppressed.

In the embodiment, the rotating operation and the bias application of the photosensitive drums 1*a* to 1*c* of the first to third stations 10*a* to 10*c* and the like are not executed in the monochromatic mode. Therefore, an abrasion of the photosensitive drums 1*a* to 1*c* or the like can be prevented. A life of the cartridge which is used only in the full-color mode can be extended and can be further economically used.

By individually providing the abut-on/keep-off mechanism of the photosensitive drum and the intermediate transfer belt for each station, such a situation that the secondary transfer remaining toner is concentratedly collected in the first station 10*a* in the full-color mode can be lightened and it is much desirable. In this case, if only the photosensitive drum 1*a* of the first station 10*a* is separated from the intermediate transfer belt 50 after completion of the primary transfer process in the first station 10*a* in the full-color mode, a part of the secondary transfer remaining toner can be allowed to pass to the downstream side. Therefore, such a situation that the secondary transfer remaining toner is concentratedly collected in the first station 10*a* can be suppressed. Further, after the secondary transfer remaining toner was collected by the second station 10*b* only for a predetermined time, the photosensitive drum 1*b* of the second station 10*b* is separated from the intermediate transfer belt 50 and the secondary transfer remaining toner can be collected by the third station 10*c*. Thus, a balance of the collection amounts of the waste toner in the second and third stations 10*b* and 10*c* can be held. That is, the intermediate transfer belt 50 can be separated from the photosensitive drums 1*a* and 1*b* of the first and second stations 10*a* and 10*b* at timing similar to that when the bias which is applied to the primary transfer roller is switched in embodiment 1 and the secondary transfer remaining toner can be allowed to pass.

In this case, since a certain time is required for the abut-on/keep-off mechanism of the photosensitive drum and the intermediate transfer belt to reciprocate the abut-on/keep-off states, it is difficult to frequently switch the abut-on/keep-off states for a period of time during which the secondary transfer remaining toner is passing. If the photosensitive drum is separated from the intermediate transfer belt during the primary transfer process, since the primary transfer is interrupted and the defective image occurs, it is undesirable. Therefore, it is desirable to use a method whereby for a period of time during which the primary transfer process is not executed and before the secondary transfer remaining toner passes, the secondary transfer remaining toner is collected only for a predetermined time from the station on the upstream side in the moving direction of the surface of the intermediate transfer belt and, thereafter, the photosensitive drum is sequentially separated from the intermediate transfer belt. Further, if the abut-on/keep-off operation of the photosensitive drum and the intermediate transfer belt is executed while the primary transfer is executed by another station, there is a fear that the image is disturbed by its mechanical shock. Therefore, it is desirable to make the abut-on/keep-off mechanism of the photosensitive drum and the intermediate transfer belt operative for a period of time during which the primary transfer is not executed by all of the stations and for a period of time during which the secondary transfer is not executed either.

In the case of executing the keep-off operation of the intermediate transfer belt and the photosensitive drum, the bias which is applied to all of the primary transfer rollers can be maintained to the bias at the time of the ordinary primary transfer or the application of the bias can be also turned off before or after the keep-off operation. In this case, it is much desirable that such a voltage as to set the surface potential of the photosensitive drum and the surface potential of the intermediate transfer belt to an almost equal potential is applied to the transfer unit and the abut-on/keep-off operation of the intermediate transfer belt and the photosensitive drum is executed. Thus, such a situation that at the time of the abut-on/keep-off operation of the intermediate transfer belt and the photosensitive drum, a discharge is caused between the transfer unit and the photosensitive drum and an electrical memory is produced in the photosensitive drum can be prevented. Further, in order to prevent a slide scratch from being caused on the photosensitive drum, it is desirable to equalize a moving speed of the surface of the photosensitive drum and a moving speed of the intermediate transfer belt and execute the abut-on/keep-off operation of the intermediate transfer belt and the photosensitive drum. That is, it is desirable that if either the intermediate transfer belt or the photosensitive drum has been stopped, the other is also stopped and if one of them is rotating, the other is also rotated.

As mentioned above, according to the embodiment, by changing the abut-on/keep-off states of the photosensitive drum and the intermediate transfer belt according to the full-color mode and the monochromatic mode, such a situation that the secondary transfer remaining toner is concentratedly collected to the first station can be suppressed and the cartridge can be economically used. According to the embodiment, in the monochromatic mode, in the station which forms the toner image only in the full-color mode, the photosensitive drum is separated from the intermediate transfer belt. Therefore, in the monochromatic mode, such a situation that the secondary transfer remaining toner is collected in the station which forms the toner image only in the full-color mode is suppressed and the cartridge which is used only in the full-color mode can be economically used.

Although the invention has been described above with respect to the specific embodiments, it will be understood that the invention is not limited to the foregoing embodiments.

For example, although the case where a plurality of stations has been arranged in order for the colors of Y, M, C, and K has been shown as an example in the above embodiments 1 and 2, if the first station is other than the station for the K color, the invention can be desirably used. When considering the productivity of the monochromatic mode, it is particularly desirable that the station for the K color is a last station in the forming order of the toner images of a plurality of colors. In such a case, order of the colors of the toner images which are formed by the first to third stations may be set to arbitrary order.

Although the waste toner container has been provided for the process cartridge and detachable from the main body of the image forming apparatus in each of the above embodiments, the invention acts fairly effectively so long as at least the waste toner container is detachable from the main body of the image forming apparatus. However, even in the case where the waste toner container has been fixed to the main body of the image forming apparatus and, for example, when the waste toner container is filled with the toner, the toner is removed and collected from the waste toner container by a predetermined operation, effects similar to those mentioned above can be obtained by applying the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-027411, filed Feb. 6, 2007, which is hereby incorporated by reference herein in its entirety.

What is claimed is:

1. An image forming apparatus comprising:

a plurality of image bearing members each of which bears a toner image;

an endless intermediate transfer member which is rotatable; and a charge member that charges toner adhered on said endless intermediate transfer member, wherein a toner image is primary-transferred from only a predetermined image bearing member among said plurality of image bearing members to said endless intermediate transfer member in a mono-color mode or a toner image is primary-transferred from all of said plurality of image bearing members to said endless intermediate transfer member in a full-color mode, wherein in the mono-color mode, the adhered toner charged by said charge member moves to the predetermined image bearing member so that the adhered toner is collected from said endless intermediate transfer member, and wherein in the full-color mode, the adhered toner charged by said charge member moves to image bearing members among said plurality of image bearing members except the predetermined image bearing member so that the adhered toner is collected from said endless intermediate transfer member.

2. An apparatus according to claim 1, wherein the predetermined image bearing member is positioned at the most downstream portion in a rotation direction of said endless intermediate transfer member.

3. An apparatus according to claim 1, wherein the predetermined image bearing member bears a toner image of a black color.

4. An apparatus according to claim 1, wherein said charge member charges the adhered toner in a normal polarity and an opposite polarity of toner.

5. An apparatus according to claim 4, wherein said plurality of image bearing members form a primary transfer part with a corresponding plurality of first transfer members through said endless intermediate transfer member.

6. An apparatus according to claim 5, wherein in the mono-color mode, the plurality of first transfer members contact said endless intermediate transfer member, and voltages in the normal polarity and the opposite polarity of toner are applied to first transfer members among the plurality of first transfer members that correspond to the image bearing members among said plurality of image bearing members except the predetermined image bearing member.

7. An apparatus according to claim 5, wherein in the mono-color mode, the image bearing members among said plurality of image bearing members except the predetermined image bearing member separate from said endless intermediate transfer member.

8. An apparatus according to claim 1, wherein in a case where said image forming apparatus continuously transfers images on a plurality of recording materials in the full-color mode, the adhered toner is moved from said endless intermediate transfer member to a most-upstream image bearing member simultaneously at a time when a toner image is transferred from the most-upstream image bearing member to said endless intermediate transfer member, the most-upstream image bearing member being an image bearing member among said plurality of image bearing members that is positioned at the most upstream portion in a moving direction of said endless intermediate transfer member.

9. An apparatus according to claim 1, wherein in a case where said image forming apparatus continuously transfers images on a plurality of recording materials in the mono-color mode, the adhered toner is moved from said endless intermediate transfer member to the predetermined image bearing member simultaneously at a time when a toner image is transferred from the predetermined image bearing member to said endless intermediate transfer member.

10. An image forming apparatus comprising:

a plurality of image bearing members each of which bears a toner image; and an endless intermediate transfer member which is rotatable, wherein a toner image is primary-transferred from only a predetermined image bearing member among said plurality of image bearing members to said endless intermediate transfer member in a mono-color mode or a toner image is primary-transferred from all of said plurality of image bearing members to said endless intermediate transfer member in a full-color mode, wherein in the mono-color mode, the adhered toner adhered on said endless intermediate transfer member moves to the predetermined image bearing member so that the adhered toner is collected from said endless intermediate transfer member, and wherein in the full-color mode, the adhered toner adhered on said endless intermediate transfer member moves to image bearing members among said plurality of image bearing members except the predetermined image bearing member so that the adhered toner is collected from said endless intermediate transfer member.

* * * * *